US005107606A

United States Patent [19]

Tsubaki et al.

[11] Patent Number: 5,107,606

[45] Date of Patent: Apr. 28, 1992

[54] DRUM TYPE WASHING APPARATUS AND METHOD OF PROCESSING THE WASH USING SAID APPARATUS

[75] Inventors: Yasuhiro Tsubaki; Kazuo Kitajima; Hidetoshi Ishihara; Shoichi Hayashi; Atsushi Ueda; Kenichi Yagami; Shuji Yamada, all of Aichi, Japan

[73] Assignees: Mitsubishi Jukogyo Kabushiki Kaisha, Tokyo; Churyo Engineering Kabushiki Kaisha, Aichi, both of Japan

[21] Appl. No.: 701,364

[22] Filed: May 10, 1991

Related U.S. Application Data

[63] Continuation of Ser. No. 556,873, Jul. 19, 1990, abandoned, which is a continuation of Ser. No. 315,948, Feb. 23, 1989, abandoned.

[30] Foreign Application Priority Data

| | | | |
|---|---|---|---|
| Feb. 23, 1988 | [JP] | Japan | 63-40513 |
| Mar. 15, 1988 | [JP] | Japan | 63-61281 |
| Jul. 28, 1988 | [JP] | Japan | 63-188661 |
| Sep. 13, 1988 | [JP] | Japan | 63-227418 |
| Oct. 26, 1988 | [JP] | Japan | 63-139766[U] |
| Dec. 6, 1988 | [JP] | Japan | 63-306942 |
| Jan. 25, 1989 | [JP] | Japan | 1-15580 |

[51] Int. Cl.[5] ..... D06F 23/00

[52] U.S. Cl. ..... 34/133 A; 34/133 N; 68/19.2; 68/20; 68/23 R; 68/24; 68/142; 68/171

[58] Field of Search ..... 68/19.2, 20, 23 R, 23.1, 68/23.2, 23.3, 24, 25, 26, 58, 74, 142, 148, 152, 153, 154, 171, 172, 173, 174, 29, 30, 60, 139, 140, 141, 143; 34/133, 139, 133 A, 133 N; 210/380.1, 380.2, 380.3; 51/164.1; 209/288, 294; 366/234

[56] References Cited

U.S. PATENT DOCUMENTS

| | | | |
|---|---|---|---|
| 965,813 | 7/1910 | Greist | 51/164.1 |
| 1,247,798 | 11/1917 | Dohn | 34/133 |
| 1,301,055 | 4/1919 | Humberger | 68/20 X |
| 1,641,780 | 9/1927 | Parker | 68/23 R X |

(List continued on next page.)

FOREIGN PATENT DOCUMENTS

| | | | |
|---|---|---|---|
| 677929 | 3/1966 | Belgium . | |
| 54165 | 10/1890 | Fed. Rep. of Germany | 210/380.1 |
| 829159 | 1/1952 | Fed. Rep. of Germany . | |
| 890037 | 9/1953 | Fed. Rep. of Germany . | |
| 2513660 | 10/1975 | Fed. Rep. of Germany . | |
| 1113123 | 11/1955 | France . | |
| 1370320 | 7/1964 | France . | |
| 63-51899 | 4/1988 | Japan . | |
| 390859 | 8/1965 | Switzerland | 68/23.3 |
| 183815 | 4/1923 | United Kingdom | 68/24 |
| 467594 | 6/1937 | United Kingdom . | |
| 2095705 | 10/1982 | United Kingdom | 68/23 R |

*Primary Examiner*—Philip R. Coe

*Attorney, Agent, or Firm*—Toren, McGeady & Associates

[57] ABSTRACT

A drum type washing apparatus and a method of processing the wash using the drum type washing apparatus wherein they have a characterizing feature which consists in that the peripheral wall of a rotary drum made of a perforated plate is configured in the form of a wall having a single corrugated portion or a plurality of corrugated portions which do not intersect the direction of centrifugal force generated by rotation of the rotary drum at right angles. Further, they have other characterizing features which consist in that the apparatus is provided with a liquid injecting nozzle and/or a gas blowing nozzle and/or a hot air blowing nozzle for allowing liquid and/or gas and/or hot air to be injected and/or blown into the interior of the rotary drum whereby a period of time required for performing steps of washing, dewatering and drying the wash in the rotary drum can be shortened. Moreover, they have another characterizing feature which consists in that the rotary drum is rotated and air is blown into the interior of the rotary drum while a door is kept opened so that the wash can be discharged from the rotary drum at a high efficiency under the influence of force generated by flowing of the air.

2 Claims, 26 Drawing Sheets

U.S. PATENT DOCUMENTS

| | | | |
|---|---|---|---|
| 1,847,159 | 3/1932 | Adams | 210/380.1 X |
| 2,213,453 | 9/1940 | Schmidt | 68/139 X |
| 2,406,494 | 8/1946 | Ferris | 34/133 X |
| 2,500,861 | 3/1950 | Phillips, Jr. | 51/164.1 |
| 2,580,435 | 1/1952 | Kirby | 210/380.2 X |
| 2,908,086 | 10/1959 | Fuhring | 34/133 |
| 3,358,301 | 12/1967 | Candor et al. . | |
| 3,387,385 | 6/1968 | Mandarino, Jr. et al. | 34/133 |
| 3,444,710 | 5/1969 | Gaugler et al. . | |
| 3,524,263 | 8/1970 | Olde, Jr. et al. | 34/133 X |
| 3,546,903 | 12/1970 | Hertig | 68/24 X |
| 4,285,219 | 8/1981 | Grunewald | 68/19.2 |

DRUM TYPE WASHING APPARATUS AND METHOD OF PROCESSING THE WASH USING SAID APPARATUS

This is a continuation application of Ser. No. 07/556,873, filed Jul. 19, 1990, and now abandoned; which in turn is a continuation application of Ser. No. 07/315,948, filed Feb. 23, 1989, and now abandoned.

FIELD OF THE INVENTION AND RELATED ART STATEMENT

The present invention relates to a drum type washing apparatus usable on the domestic basis as well as on the industrial basis to process the wash wherein at least one step among steps of washing, dewatering and drying inclusive a step of dry cleaning can be performed in a single unit to process the wash, e.g., various kinds of underwears in individual home or linens, bed sheets or the like in hotel, hospital or the like facilities. Further, the present invention relates to a method of processing the wash using the drum type washing apparatus wherein the wash can be automatically discharged from the interior of a rotary drum in a washing/dewatering unit or a drier to which the present invention is applied.

Hitherto, the laundry industry has offered such laundry services as comprising the receiving of soiled cloths such as towels, sheets, bandages, uniforms or the like (hereinafter generally referred to as linens) from hotel, hospital or the lthe ike facilities, processing of them for the purpose of reuse and the delivering of cleaned linens to hotel, hospital or the like facilities. Steps of processing are usually divided into (1) washing, (2) dewatering, (3) drying and (4) finishing. In a case where linens such as towels or the like should be completely dried, steps (1) to (3) are required. On the other hand, in a case where linens such as sheets, bandages, uniforms or the like should be finished by ironing, steps (1) to (4) are required (It should be noted that a step (3) of drying is performed within a short period of time).

With a conventional apparatus, in general, linens are first washed and dewatered and after completion of steps of washing and dewatering the linens are conveyed to a drier in which a step of drying is performed.

The conventional apparatus in which steps of washing and dewatering are continuously performed includes a rotary drum of which wall is made of a perforated plate, and a plurality of beaters are attached to the wall of the rotary drum so that the linens are lifted up from the inner wall surface of the rotary drum as the latter is rotated. With this construction, the linen are usually washed in the presence of detergent under the influence of shock appearing over the water surface when they fall down. On completion of the step of washing, the rotary drum in turn is rotated at a higher rotational speed so that water involved in the linens is dewatered therefrom under the effect of centrifugal force generated by rotation of the rotary drum at such a high rotational speed. On completion of the step of dewatering, a laundryman stops operation of the apparatus and displaces the linens in a wagon or the like to carry them to a drier in which a next step of drying is performed. To dry the linens, a rotary drum type drier is usually employed which includes a rotary drum in which the washed and dewatered linens are dried by blowing hot air into the interior of the rotary drum. A period of time required for performing a step of drying in the rotary drum differs in dependence on the kinds of linens which are typically divided into two kinds, one of them being linens such as towels or the like which require complete drying and the other one being half-dried linens such as sheets, bandages, uniforms and so forth which are conveyed to a next shop where they are finished by ironing. Thus, a drying time is properly selected in dependence on the kinds of linens to be dried.

The above description has been generally referred to the prior art which requires that steps of washing and dewatering and a step of drying are performed using two independent units. As a special case, a so-called washing/dewatering/drying unit is already commercially sold in which steps of washing, dewatering and drying are successively performed using a single unit.

Since this type of unit is so constructed that steps of washing, dewatering and drying are performed without discontinuance, it is unnecessary that a laundryman carries linens in the course of washing operation as is the case with the separate type unit. In fact, however, the unit has the following restrictions from the viewpoint of structure, resulting in the unit failing to be widely put in practical use.

(1) When steps of washing, dewatering and drying are continuously performed in the conventional unit, a period of time required for executing these steps one after another is prolonged substantially longer than a total value of time comprising a time required by the conventional washing/dewatering unit and a time required by the drier, resulting in productibity being reduced. This is attributable to the fact that a perforation rate of the rotary drum is restricted within the range of 20 to 30% from the viewpoint of mechanical strength of the rotary drum which should be rotated at a higher rotational speed to perform a step of continuous dewatering. Since an ordinal drier has a perforation rate of about 60%, it is obvious that the conventional washing-/dewatering apparatus has a reduced air venting efficiency compared with the drier and this leads to a result that a drying time is prolonged.

(2) After completion of the steps of washing and dewatering, it is often found that some kind of linens, e.g., towels, sheets or the like are brought in tight contact with the inner wall surface of the rotary drum. This makes it difficult to remove the linens away from the inner wall surface of the rotary drum during a period of drying, resulting in uniform drying being achieved only with much difficulties. Sometimes, there arises a necessity for interrupting operation of the unit to manually remove the linens from the inner wall surface of the rotary drum.

(3) Generally, an operation for removing the linens from the rotary drum after completion of a step of washing is a severe task which requires a high intensity of force to be given by a young laundryman. Accordingly, a request for facilitating removal operation has been raised from the laundry industry.

Now, description will be made in more details below as to structure of the rotary drum which has been used for the conventional washing/dewatering/drying unit.

A rotary drum type dewatering unit adapted to perform a step of dewatering under the effect of centrifugal force is identical to each of a washer usable in individual home, a laundry washer, a dry cleaner in which an organic solvent is used as a washing medium and a centrifugal type dewatering unit usable on the industrial base as far as a fundamental structure associated with dewatering operation is concerned. Therefore, description will be typically made with reference to a washer usable in individual home.

As shown in FIGS. 29(A) and 29(B), a dewatering barrel 1 is composed of a rotary drum 2 of which cylindrical wall is made of a perforated plate having a perforation rate in the range of 10 to 20%, a rotational shaft 3 adapted to support the rotary drum 2 to rotate the latter and a motor 4 for rotating the rotational shaft 3. Reference numeral 9 designates a number of holes which are drilled through the cylindrical wall 7, reference numeral 10 does a water discharge pipe attached to the bottom of the dewatering barrel 1 and reference numeral 11 does a plurality of vibration proof rubbers interposed between the motor 4 and the base platform of the washer.

After completion of a step of washing, linens 5 are introduced into the dewatering barrel 1 from a washing barrel (not shown), the dewatering barrel 1 is closed with a lid 6 and a desired period of time is then set using a timer switch (not shown). Then, the rotary drum 2 is rotated at a higher speed by the motor 2 so that water in the linens 5 is discharged through the cylindrical wall 7 made of a perforated plate of which center axis coincides with that of the rotary drum 2.

The inventors examined the prior art as mentioned above by measuring a water content of each of the linens 5' at the time when a step of dewatering is substantially completed, the linens 5' being placed round the inner wall surface of the cylindrical wall 7 in a layered structure while having an uniform thickness as viewed in the peripheral direction, as shown in FIG. 30. Results derived from the measurements reveal that the linens 5' located in the proximity of the inner wall surface of the cylindrical wall 7 has a water content about two times as much as that of the linens 5' located remote from the inner wall surface of the cylindrical wall 7, i.e., the linens 5' located near to the axis of rotation of the cylindrical wall 7, as shown in FIG. 31.

This is because of the fact that the cylindrical wall 7 extends at right angles relative to the direction of centrifugal force as is best seen in FIG. 30 so that water remaining between the linens 5 and the inner wall surface of the cylindrical wall 7 is prevented from moving along the inner wall surface of the cylindrical wall 7, resulting in the water retained therebetween failing to be discharged from the linens 5'. On the other hand, since water involved in the linens 5' located remote from the inner wall surface of the cylindrical wall 7 is caused to smoothly move through capillary tubes in the linens 5' in the direction R of centrifugal force, the result is that the linens 5' located in the proximity of the central part of the rotary drum 2 have a water content less than that of the linens 5' located in the proximity of the inner wall surface of the cylindrical wall 7, as shown in FIG. 31.

Additionally, there is a tendency that the linens 5' located in the proximity of the inner wall surface of the cylindrical wall 7 has a water content which is increased more and more as a thickness of the linens 5' is reduced. It is believed that this is attributable to the fact that the linens 5' (located remote from the inner wall surface of the cylindrical wall 7) to serve for thrusting the linens 5' located in the proximity of the inner wall surface of the cylindrical wall 7 in the direction of centrifugal force has a reduced weight, causing an effect of squeezing the water to be reduced.

As will be readily apparent from the above description, since the conventional dewatering unit is so constructed that the cylindrical wall 7 constituting the rotary drum 2 extends at right angles relative to the direction 8 of centrifugal force, it has significant drawbacks that water involved in the linens 5 located near to the inner wall surface of the cylindrical wall 7 can not be satisfactorily discharged from the rotary drum 2 and thereby a property of dewatering which can be expected in nature from an intensity of centrifugal force fails to be exhibited to satisfaction. As a result, an extra quantity of energy and time are naturally consumed for the purpose of drying the linens after completion of a step of dewatering.

Next, a step of washing to be performed with the use of a conventional unit will be described below with reference to FIG. 32 which schematically illustrates a drum type washing unit.

Specifically, FIG. 32 is a schematic sectional view illustrating the drum type washing unit which is maintained during a period of washing.

In the drawing, reference numeral 21 designates a washing barrel, reference numeral 22 does a rotary drum, reference numeral 23 does a plurality of beaters for lifting up linens 25 while the rotary drum 22 is rotated in the direction (as identified by an arrow mark 26) and reference numeral 24 does a washing water which has been introduced into the interior of the washing drum 21 via a water supply piping 31.

Reference numeral 27 designates a lint filter for catching waste threads (lints) derived from the linens 25. The lint filter 27 is accommodated in a filter box 28 having a water discharge valve 29 connected thereto.

With this construction, a water level of the washing water 24 is monitored by a water level meter (designed in a float type, a hydraulic pressure type or the like) which is not shown in the drawing, and when a predetermined quantity of water is introduced into the washing barrel 21, a water supply valve 30 is closed automatically.

The rotary drum 22 is rotated when water supply is started. It continues to be rotated for a period of time set by a timer circuit and associated components (not shown) even after the washing water 24 reaches a predetermined value of water level so that so-called beat washing is performed for the linens 25 by allowing the latter to be lifted up by the beaters 23 and then caused to fall down. After completion of the step of washing, the water discharge valve 29 is opened whereby waste washing water 24 is discharged from the rotary drum 22 to the outside while flowing through the filter 27.

As described above, according to the conventional method of washing the linens 25 using a rotary drum, the linens 25 are washed by repeatedly lifting up them by the beaters 23 and then causing them to fall down by their own dead weight. This allows an upper limit of the number of revolutions of the rotary drum 22 to be defined in the range of 0.7 to 0.8 G which is represented in terms of a gravity acceleration. If the rotary drum 22 is rotated at a higher speed as represented by more than 1 G, the linens 25 are brought in tight contact with the inner wall surface of the rotary drum 22 with the result that the linens 25 can not fall down, causing an effect of washing operation to be reduced remarkably.

It is obvious from the viewpoint of an effect of washing operation that the number of drops of the linens 25 can be increased more and more by increasing the number of revolutions of the rotary drum as far as possible with the result that an effect of agitation can be increased remarkably accompanied by an improved property of washing or a reduced time required for performing a step of washing. However, the number of revolutions of the rotary drum can not be set to a high level in excess of 1 G for the foregoing reasons and this offers a significant obstruction appearing when a washing time is to be shortened.

Next, a conventional step of dewatering will be described below with reference to FIGS. 33 and 34 which schematically illustrate structure of a rotary drum.

As shown in FIG. 33, the washing/dewatering unit includes a rotary drum 42 of which cylindrical wall is formed with a number of communication holes 41, and a plurality of beaters 44 (three beaters in the illustrated case) are attached to the inner wall surface of the rotary drum while projecting in the inward direction. In the drawing, reference numeral 45 designates a main shaft for supporting the rotary drum and reference numeral 46 does bearings for rotatably supporting an assembly of the rotary drum 42 and the main shaft 45.

With such washing/dewatering unit, linens to be washed are introduced into the interior of the rotary drum 42 to be washed and after completion of the step of washing, rinsing operations are performed by several times so that the process goes to a step of dewatering to be performed by rotating the rotary drum 42 at a higher rotational speed. It should be noted that during a period of dewatering there may arise a difficult problem that the linens can not be removed from the rotary drum 42 because the latter are brought in tight contact with the inner wall surface of the rotary drum 42 due to penetration of a part of the linens into the communication holes 41 during rotation of the rotary drum at a high rotational speed.

To obviate the foregoing problem, there have been already raised a variety of proposals for preventing the linens from coming in tight contact with the inner wall surface of the rotary drum 42. One of the proposals is such that a plurality of tight contact prevention plates 47 having an adequate configure and dimensions are secured to a part of the inner wall surface of the rotary drum located between the adjacent beaters 44. As is best seen in FIG. 34, the tight contact prevention plates 47 may be designed either in the form of a flat plate as seen on the side walls or in the form of a hill-shaped member as seen on the bottom side of the rotary drum 42.

According to this proposal, since each of the tight contact prevention plates 47 is secured to a part of the inner wall surface of the rotary drum 42 between the adjacent beaters 44, no penetration of a part of the linens 48 into the communication holes 41 takes place during a period of dewatering because the communication holes 41 located at a part between the adjacent beaters 44 and a part of the inner wall surface of the rotary drum 42 occupied by the tight contact prevention plate 47 are covered with the beaters 41 and the tight contact prevention plate 47. Thus, washing water in the linens 48 is discharged from the rotary drum 42 only through other communication holes 41. This makes it possible to easily remove the linens 48 from the interior of the rotary drum 42 while slowly turning the latter because no penetration of a part of the linens 48 into the communication holes 41 takes place at a part between the adjacent beaters 44 and a part of the inner wall surface of the rotary drum 42 occupied by the tight contact prevention plate 47 as mentioned above, although some part of the linens 48 is penetrated into the communication holes 41 at an area where that latter are not closed with the beaters 44 and the tight contact prevention plates 47.

After completion of the step of washing, the process goes to a next step of dewatering during which washing water involved in the linens 48 is separated therefrom by rotating the rotary drum 42 at such a higher rotational speed that causes a high intensity of centrifugal force (represented, e.g., by 300 G) to be generated. This permits a part of the linens 48 to be penetrated into the communication holes 41 under the effect of the centrifugal force generated in that way whereby the linens are brought in tight contact with inner wall surface of the rotary drum 42.

To prevent the linens from coming in tight contact with the inner wall surface of the rotary drum 42, there was made the above-mentioned proposal that some part of the communication holes 41 are closed with a plurality of tight contact prevention plates 47 so that the linens 48 can be easily removed from the inner wall surface of the rotary drum 42. In spite of the fact that a principal object of the step of dewatering is to discharge washing water through the communication holes 41, however, the above proposal is achieved by closing a part of the communication holes 41 with a dewatering rate being reduced to some extent, in order to prevent the linens 49 from being brought in tight contact with the inner wall surface of the rotary drum. Accordingly, a large quantity of energy is required in correspondence to a degree of reduction of the dewatering rate for performing a subsequent step of drying.

Next, a conventional step of drying will be described below with reference to FIGS. 35 to 37.

FIGS. 35 to 37 are a schematic view of a conventional drier or washing/dewatering/drying unit, respectively, particularly illustrating the flowing of a hot air in the surrounding area of a rotary drum.

First, description will be made with reference to FIG. 35 as to a step of drying.

In the drawing, reference numeral 51 designates a rotary drum, reference numeral 52 does an air heater comprising a steam jacket or the like, reference numeral 53 does linens and reference numeral 54 does a suction type blower adapted to suck a hot air 55' and then discharge it from the drying system to the outside.

According to the illustrated arrangement, the hot air 55' which has moved through the air heater 52 via an air intake port 56 disposed above the rotary drum 51 is sucked, it is then introduced into the interior of the rotary drum 51 through the holes on the wall of the rotary drum 51 while flowing round the outer wall surface of the latter until it comes in contact with the linens 53 and thereafter it is discharged to the outside via a suction type blower 54 and an exhaust port 57 situated below the rotary drum 51. A characterizing feature of this arrangement consists in that hot air flows in the form of a so-called laminar flow having a number of streaming lines aligned with each other, which is inherent to the suction type air flowing.

Next, description will be made further with reference to FIG. 36 as to the step of drying. The unit shown in FIG. 36 is substantially similar to that in FIG. 35 in structure. As is apparent from FIG. 37 which is a sectional side view of the unit, the latter includes a hot air distributing box 58 located above the rotary drum 51 so that the hot air 55' is positively introduced into the rotary drum 51 from the front part of the upper half of the latter to flow uniformly within the interior of the rotary drum 51. This arrangement exhibits an effect of laminar flow more clearly than in the case as shown in FIG. 35.

As will be readily apparent from the above description, a main feature of the conventional suction type arrangement consists in employment of the suction blower 54 which assures that the hot air 55' is introduced into the rotary drum 51 in the form of a laminar flow and thereby the linens 53 which have been lifted up in the rotary drum 51 as the the latter is rotated are dried in a floated state.

In this manner, the conventional unit employs the suction type arrangement to bring hot air into the rotary drum so that the hot air flows in the form of a so-called laminar flow. Usually, an average flowing speed of the hot air is determined in the range of 1 to 5 m/sec. In an extreme case, it has the maximum flowing speed less than 5 m/sec.

With this construction, to assure that linens are effectively brought in contact with hot air within the interior of the rotary drum, it is necessary that the number of revolutions of the rotary drum is determined in the range of 0.7 to 0.8 G in terms of a gravity acceleration and the linens are floated in the atmosphere including hot air in the form of a laminar flow. If the rotary drum is rotated at a higher rotational speed as represented by more or less 1 G or in excess of 1 G, the result is that the linens are brought in tight contact with the inner wall surface of the rotary drum, causing them to be dried only with much difficulties. In other words, an opportunity for allowing a mass of linens located at the lower part of the rotary drum to be floated in hot air as the rotary drum is rotated is obtainable with the highest possibility when the rotary drum is rotated at a rotation speed which remains in the range of 0.7 to 0.8 G. Thus, if the rotary drum is rotated at a lower speed, the result is that the above opportunity is obtainable with a reduced possibility.

Further, since an average flowing speed of the hot air is maintained at a low level of ½ m/sec, a relative speed of the hot air to the linens can not be set to a high level. Strictly speaking, discharging of water vapor produced from the linens is achieved with a delay corresponding to reduction of the relative speed of hot air to the linens.

For the foregoing reasons, an average drying time is usually set in the range of 30 to 40 minutes in accordance with the conventional suction type drying manner. Accordingly, a request for a drier which assures that a drying time can be shortened substantially compared with the conventional drying manner has been raised from the laundry industry.

On the other hand, the conventional drying manner is performed such that linens which have been washed and dewatered are introduced into the rotary drum and the latter is then rotated at a rotational speed under a condition of the centrifugal acceleration as represented by less than 1 G in terms of a gravity acceleration appearing round the inner wall surface of the rotary drum. Thereafter, the linens are lifted up away from the inner wall surface of the rotary drum by activating the beaters attached to the inner wall surface of the rotary drum and they are then caused to fall down by their own dead weight so that they are dried by blowing hot air into the interior of the rotary drum.

To this end, the rotary drum requires a sufficient volume of space in which linens can move freely while they remain within the interior of the rotary drum. Generally, a space about two times as wide as the space set for performing the preceding step of dewatering is required for performing a step of drying. Accordingly, a conventional fully automatic washing/dewatering/drying unit including a single rotary drum in which steps of washing, dewatering and drying are successively performed requires a volume of space two times as large as that of the conventional washing/dewatering unit, causing a manufacturing cost required for manufacturing the unit and dimensions determined for the same to be increased substantially.

Here, for the purpose of reference, description will be made below as to a calculation standard (provided by Japan Industrial Machinery Manufacturer Association) for a standard quantity of load to be carried by a washing/dewatering unit for a laundry shop.

$$\text{standard quantity of load to be borne } Q = f \cdot \frac{1}{4} \pi D^2 L$$

where f designates a load rate in $Kg/m^3$ wherein f is represented by 45+30 D in a case of a washing/dewatering unit and it is represented by 40 in a case of a drier, D does an inner diameter of the rotary drum in meter and L does a inner length of the rotary drum in meter.

The inner length of the rotary drum represents a dimension which is determined such that linens can be introduced into and removed from the rotary drum. Concretely, it is determined in the range of 1.0 to 1.3 m in a case where the rotary drum is charged with a normal quantity of load of 30 Kg. In this case, a drier has a volume of space as represented by a ratio of 1.875 to 2.1 compared with that of the washing/dewatering unit.

If an excessive quantity of load more than the above standard quantity of load is introduced into the rotary drum of the conventional washing/dewatering unit during a step of drying, it has been confirmed that linens are dried with fluctuation in degree of dryness from location to location as viewed round the inner wall surface of the rotary drum due to immovability of the linens within the interior of the rotary drum and moreover the linens require a long drying time in comparison with the quantity of load. Another problem is that if the linens are excessively dried to eliminate the fluctuation in degree of dryness, they tend to have a remarkably reduced period of running life.

Next, description will be made below as to discharging of linens, i.e., removal of the same.

As shown in FIGS. 40 and 41, a conventional washing/dewatering unit in which steps of washing and dewatering are successively performed includes a rotary drum 60 of which cylindrical wall is made of a perforated plate 61, and a step of washing is performed in such a manner that linens are repeatedly lifted up by activating a plurality of beaters 62 as the rotary drum is rotated and they are then repeatedly caused to fall down by their own dead weight. When the step of washing is terminated, the rotary drum 60 is rotated at a higher speed so as to allow the linens to be dewatered. On completion of the step of dewatering, an operator stops rotation of the washing/dewatering unit and then opens a door 63 to manually remove from the interior of the rotary drum 60 the linens which have been brought in tight contact with the inner wall surface of the rotary drum under the influence of centrifugal force. Thereafter, he discharges the wet linens from the rotary drum to the outside and then puts them in a wagon or the like means to carry them to a drier.

Thereafter, he opens a door of the drum type drier to introduce the linens into a rotary drum so that they are dried by blowing hot air into the interior of the rotary drum while the latter is rotated.

After he confirms that the linens have been completely dried, he stops operation of the drier, opens the door, manually removes the linens from the interior of the rotary drum and then puts them in a wagon or the like means to carry them to a next step.

As described above, when linens are to be processed in the conventional washing/dewatering unit, they are introduced into the rotary drum and after completion of steps of washing and dewatering, they are manually removed from the interior of the rotary drum. Since the linens are brought in tight contact with the inner wall surface of the rotary drum under the effect of centrifugal force generated by rotation of the linens at a higher speed during a step of dewatering in dependence on the kind of linens, removal of the linens from the interior of the rotary drum after completion of the step of dewatering is a serve task which usually requires a high magnitude of power to be given by a young man.

When the linens are removed from the interior of the rotary drum, it is hardly found that they have been brought in tight contact with the inner wall surface of the rotary drum. However, it is necessary that an operator stoops to extend his hands into the interior of the rotary drum or in some case it is required that he removes the linens therefrom while allowing an upper half of his body to be exposed to the hot atmosphere in the interior of the rotary drum. To eliminate the foregoing inconveninece, a technique for removing linens from the rotary drum after completion of the step of drying was already proposed in Japanese Utility Model Application NO. 19266/1980. This technique is embodied in the form of an apparatus which is so constructed that an inlet port through which wet linens are introduced into the rotary drum is situated on the front door side and an outlet port through which dried linens are removed therefrom is situated on the rear door side. However, with this construction, the whole apparatus tends to be designed in larger dimensions.

As is apparent from the above description, operation for removing linens from the interior of the rotary drum is a hard task which is disliked by anybody. Accordingly, a request for improving such severe task of removing linens from the rotary drum has been raised from the laundry industry.

Now, with the foregoing background in mind, subjects to be solved will be summarized in the following.

To successively perform steps of washing, dewatering and drying, it is necessary that a period of time required for performing the respective steps is substantially shortened and linens can be easily removed away from the inner wall surface of a rotary drum after completion of the step of drying. Particularly, to shorten a period of time required for performing steps of washing, dewatering and drying, the following items should be improved.

(1) Reduction of a time required for the step of washing:

It is advantageous from the viewpoint of an effect of washing that the number of revolution of rotary drum is increased as far as possible to increase the number of drops of linens so that an effect of agitation is increased substantially accompanied by an improved property of washing or a reduced washing time. However, since the number of revolutions of a rotary drum can not be set to a level in excess of 0.8 G for the aforementioned reasons, this offers a significant obstruction when a washing time is to be shortened.

(2) Reduction of a time required for the step of dewatering:

A conventional dewatering unit is usually constructed that the inner wall surface of a rotary drum extends at right angles relative to the direction of centrifugal force (while a so-called corrugation angle exhibits 180°). This construction leads to a significant drawback that water involved in linens located in the proximity of the inner wall surface of the rotary drum is not satisfactorily removed therefrom and moreover a property of dewatering to be naturally derived from an intensity of centrifugal force is not exhibited to the satisfaction of an operator. Consequently, an extra amount of energy and time are consumed for the purpose of drying linens after completion of the step of dewatering.

(3) Reduction of a time required for the step of drying:

Hot air is heretofore introduced into a rotary drum in accordance with the air suction manner. The hot air moves in the rotary drum in the form of a so-called laminar flow of which average flowing speed is determined in the range of 1 to 2 m/sec. Even when it is to flow at the highest speed, the flowing speed is set to a level less than 5 m/sec.

To assure that linens comes in contact with hot air at a high efficiency within the interior of the rotary drum, it is necessary that the number of revolutions of the rotary drum is determined in the range of 0.7 to 0.8 G in terms of a gravity acceleration and the linens are floated in the laminar flow of hot air as long as possible. If the number of revolutions of the rotary drum is set to a level of more or less 1 G or in excess of 1 G, the result is that the linens are brought in tight contact with the inner wall surface of the rotary drum and thereby drying is achieved only with much difficulties. In other words, an opportunity for allowing a mass of linens located at the lower part of the rotary drum to be floated in the hot air as the rotary drum is rotated is maximized when the umber of revolutions of the rotary drum is determined in the range of 0.7 to 0.8 G represented by a gravity acceleration. If the rotary drum is rotated at a rotational speed lower than the foregoing range, the result is that the above opportunity is adversely reduced.

Further, since an average speed of hot air remains at a a low level of ½ m/sec, a relative speed of the linens to the hot air can not be set to a high level. Strictly speaking, removing of water vapor evaporated from the linen layer is achieved with a delay corresponding to the reduced relative speed.

For the aforementioned reasons, an average drying time is set in the range of 30 to 40 minutes in accordance with the conventional suction manner. Accordingly, a request for developing a drier adapted to remarkably shorten the average drying time has been raised from the laundry industry.

(4) Easy removal of linens from a rotary drum

As mentioned above, operation for removing linens from a rotary drum is a severe task which is disliked by anyone. Accordingly, a request for improving the removing operation has been also raised from the laundry industry.

OBJECTS AND SUMMARY OF THE INVENTION

The present invention has been made with the foregoing problems in mind and its principal object resides in providing a drum type washing apparatus which is entirely free from these problems.

Other object of the present invention is to provide a drum type washing apparatus which assures that a property of dewatering inherent to the apparatus of the present invention is satisfactorily exhibited and at the same time a quantity of energy and time consumed during a step of dewatering can be reduced substantially.

Another object of the present invention is to provide a drum type washing apparatus which assures that the aforementioned restriction relative to the number of revolutions of the rotary drum can be eliminated.

Further another object of the present invention is to provide a drum type washing apparatus which assures that linens which have been brought in tight contact with the inner wall surface of the rotary drum can be mechanically removed therefrom at a high efficiency without an occurrence of closure of communication holes as well as without reduction of a dewatering rate.

Further another object of the present invention is to provide a drum type washing apparatus which assures that two significant problems are satisfactorily solved, one of them being such that a conventional apparatus has a restriction relative to the range within which the number of revolutions of the rotary drum is determined so as to allow linens to be floated in a laminar flow of hot air and the other one being such that an average speed of flowing of the linens in the atmosphere of hot air is set to a low level of 1 to 2 m/sec and thereby a relative speed of the hot air to the linens can not be determined at a high level.

Further another object of the present invention is to provide a drum type washing apparatus which offers advantageous effects that linens in a rotary drum can be uniformly dries even when the rotary drum is charged with an excessive amount of load more than a standard quantity of load and a period of time required for performing a step of drying can be shortened substantially.

Still further another object of the present invention is to provide a method of processing the wash using a drum type washing apparatus which assures that an operator is released from the hard operation for removing the wash from the apparatus, i.e., discharge operation.

To accomplish the above objects, the present invention provides the following characterizing features (1) to (9).

(1) According to the characterizing feature (1) of the present invention, the apparatus includes a rotary drum of which peripheral wall does not extend at right angles relative to the direction of centrifugal force.

(2) According to the characterizing feature (2) of the present invention, the apparatus is so constructed that the peripheral wall of a rotary drum does not extend at right angles relative to the direction of centrifugal force and the rotary drum has a corrugation angle in the range of 90° to 160°.

In connection with the above-mentioned characterizing features (1) and (2) of the present invention, it should be noted that as shown in FIG. 31 which illustrates the distribution of a water content in the linen layer as viewed toward the central part of the rotary drum, a main factor of causing an excessively high amount of water content to appear in the vicinity of the inner wall surface of the rotary drum consists in that the wall of the rotary drum extends in parallel with the axis of rotation of the rotary drum and moreover the wall of the rotary drum intersects the direction of centrifugal direction at right angles, as mentioned above, resulting in water discharging being achieved unsatisfactorily. To obviate the foregoing malfunction, it is required to take such a measure that all or a part of the wall of the rotary drum is configured so as not to extend in parallel with the axis of rotation of the rotary drum or the wall of the rotary drum is not designed in a simple cylindrical configuration but assumes a shape which does not allow it to intersects the direction of centrifugal force at right angles.

When the foregoing measure is taken, it is assured that liquid which gets together at certain position offset from holes on the wall of the rotary drum is caused to flow along the inner wall surface of the rotary drum having a predetermined angle under the effect of centrifugal force until it flows through other holes on the wall of the rotary drum. This permits a water content in the linen structure after completion of a step of dewatering to be reduced remarkably.

When the corrugation angle is set to a smaller value, a water content can be reduced but there appears a tendency that the linen layer comes in tight contact with the inner wall surface of the rotary drum. In connection with this tendency, it has been found that the apparatus in which washing, dewatering and drying are successively performed by way of a series of steps should have a desirable corrugation angle.

According to the characterizing feature (1) of the present invention, the apparatus employs a peripheral wall constituting the rotary drum which does not intersect the direction of centrifugal direction at right angles in compliance with the characterizing feature (1). This makes it possible that liquid which has gotten together along the inner wall surface of the rotary drum adapted to be rotated at a high rotational speed is caused to smoothly flow along the inner wall surface of the rotary drum until it is discharged to the outside through holes on the wall of the rotary drum. Further, according to the characterizing feature (2) of the present invention, a water content in the linen layer after completion of the step of dewatering is improved substantially compared with the conventional apparatus in respect of distribution and quantity of the water content.

In addition, according to the characterizing feature (2) of the present invention, it is assured that the water content in the linen layer after completion of a step of dewatering under the influence of centrifugal force can be improved substantially compared with the conventional apparatus, a water content in the linen layer can be uniformly distributed within the rotary drum, a period of time required for performing the step of drying can be shortened and moreover an occurrence of excessive drying can be prevented reliably. Another advantageous effects are such that an occurrence of tight contact of the linen layer with the inner wall surface of the rotary drum can be prevented and any unbalanced load can be active in the rotary drum only within a region in the proximity of a center of weight of the rotary drum.

(3) Further, the present invention provides a drum type washing apparatus includes a rotary drum made of a perforated plate to perform at least one step among steps of washing, dewatering and drying the wash in the rotary drum, wherein the apparatus is provided with a single liquid injection nozzle or a plurality of liquid injecting nozzles adapted to inject liquid toward the interior of the rotary drum from positions located outside the peripheral wall of the rotary drum.

According to the characterizing feature (3) of the present invention, washing water is introduced into the interior of the rotary drum in the form of a jet stream via the perforated plate and a step washing is performed in such a manner that linens lifted up away from the inner wall surface of the rotary drum as the latter is rotated are caused to fall down impulsively. Concretely, the apparatus is characterized in that the nozzle serves to inject washing water toward the rotary drum at an angle in the angular range of 9 o'clock to 3 o'clock represented by the short pointer of a clock.

According to the characterizing feature (3) of the present invention, the rotary drum is rotated at a rotational speed in the presence of a gravity acceleration represented by more or less 1 G (the gravity acceleration may be in excess of 1 G) and the linens are caused to fall down impulsively under the effect of jet stream of liquid injected through the nozzle, even though they are brought in tight contact with the inner wall surface of the rotary drum to some extent.

Additionally, there is no need of defining the number of revolutions of the rotary drum within the range where the rotary drum is rotated at a rotational speed represented by 0.7 to 0.8 G as is the case with the conventional apparatus. Thus, the rotary drum may be rotated at a rotational speed represented by, e.g., 0.8 to 1.2 G so that the number of drops of the linens per unit time is increased. This assures that an effect of agitation of the linens is increased and the number of drops of them is also increased whereby a performance of washing is improved and a washing time is shortened.

According to the characterizing feature (3) of the present invention, linens receive an agitating effect and an impulsively increased washing effect which are represented by $\sqrt{1.2/0.7}$ times, i.e., about 1.3 times compared with the conventional apparatus, when it is assumed that a conventional rotary drum is rotated at a rotational speed as represented by 0.7 G and a rotary drum of the present invention is rotated at a rotational speed as represented by 1.3 G. In addition, it has been experientially found that the linens receive a washing rate about two times as high as that of the conventional apparatus owing to an effect derived from impulsive drops of the linens under the influence of jet stream of liquid injected through the nozzle.

Consequently, this makes it possible to shorten a washing time to a level of half or to perform an intense washing operation at a high efficiency compared with the conventional apparatus.

(4) Further, the present invention provides a drum type washing apparatus including a rotary drum of which peripheral wall is formed with a number of communication holes and which is equipped with a plurality of beaters projecting inwardly of the inner wall surface of the rotary drum which is rotatably supported in an outer drum, wherein the apparatus is provided with a gas blowing nozzle adapted to blow gas toward the outer wall surface of the rotary drum so that gas is blown toward the rotary drum just before a step of dewatering is terminated or immediately after it is terminated.

Operations of the apparatus including the above-mentioned characterizing features (1) to (4) will be described below.

(a) When it is found that linens are brought in tight contact with the inner wall surface of the rotary drum just before the step of dewatering is terminated or immediately after it is terminated, air is blown into the interior of the rotary nozzle through the nozzle via the communication holes over the wall of the rotary drum.

(b) Air is caused to flow through the communication holes to thrust the linen so that a gap appears between the inner wall surface of the rotary drum and the linen layer. This allows the linens which have been brought in tight contact with the inner wall surface of the rotary drum to fall down by their own dead weight so that the tightly contacted linen layer is destroyed.

(c) At this moment, rotation of the rotary drum and interruption of the rotation of the same are repeated with the result that the linens are more effectively dried.

(d) As the rotary drum is continuously rotated while the tightly contacted linen layer is partially destroyed, the whole linen layer is removed away from the inner wall surface of the rotary drum.

According to the characterizing feature (4) of the present invention, linens which have been brought in tight contact with the inner wall surface of the rotary drum after completion of the step of dewatering can be automatically removed therefrom under the effect of force imparted to the linens from the outside without reduction of a dewatering rate. Thus, the drawbacks inherent to the conventional apparatus can be eliminated without reduction of a thermal efficiency.

(5) Further, the present invention provides a drum type washing apparatus including a rotary drum made of a perforated plate to perform at least one step of drying the wash in the rotary drum, wherein the apparatus is provided with a hot air blowing nozzle which is located above the rotary drum.

According to the characterizing feature (5) of the present invention, hot air is introduced into the rotary drum in accordance with a blowing manner in contrast with a conventional suction manner. The hot air is blown into the interior of the rotary drum via the perforated plate of the latter in the form of a jet stream having a flowing speed higher than 5 m/sec so that it comes directly in contact with the linens which are lifted up away from the inner wall surface of the rotary drum as the latter is rotated. Concretely, the nozzle is designed to blow hot air toward the central part of the rotary drum within the angular range of 9 o'clock to 12 o'clock or 12 o'clock to 3 o'clock represented by the short pointer of a clock.

With the above construction, the blown hot air is active directly on the linens so that a relative speed of the hot air to the linens can be increased and thereby steam vaporized from the wet linens can be quickly exhausted from the rotary drum. Consequently, a period of time required for performing the step of drying can be shortened substantially.

Although the linens are brought in tight contact with the inner wall surface of the rotary drum as the latter is rotated at a rotational speed as represented by more or less 1 G, hot air can be blown way toward the central part of the rotary drum under the effect of force generated by blowing of the hot air through the blowing nozzle. Thus, there is no need of restricting the rotational speed of the rotary drum within the range of 0.7 to 0.8 G as is the case with the conventional apparatus. Alternatively, it may set to, e.g., 0.8 to 1.2 G. This permit a frequency of exchanging the linens in the rotary drum with other ones to be increased. Advantageous effects derived from the characterizing feature (5) are such that an occurrence of irregular drying of linens can be prevented and a drying time can be reduced remarkably.

As will be readily apparent from the above description, advantageous effects derived from the characterizing feature (5) will be summarized in the following.

(a) In contrast with the conventional apparatus which requires 30 to 40 minutes for drying the linens (at the time when the rotary drum is charged with a rated quantity of load), the drum type washing apparatus of the present invention assures that a drying time can be reduced to ½ to ⅔ of that of the conventional apparatus. This makes it possible to save an energy to be consumed at the same rate.

(b) Since the blown air comes directly in contact with the linens, a loosening effect can be added to the linens, causing the dries linens to be finished in a soft fashion.

(c) Since the hot air is blown in the form of a jet stream and the rotary drum is rotated at a higher rotational speed, the linen layer can be uniformly dried at a high speed even when an excessive quantity of linens in excess of the rated quantity of load by 10 to 20% are introduced into the rotary drum.

(6) Further, the present invention provides a drum type washing apparatus including a rotary drum made of a perforated plate to perform at least one step of drying the wash in the rotary drum, wherein the rotary drum is rotatably supported by a horizontally extending shaft and hot air is blown in both axial and peripheral directions to dry linens in such a manner that the direction of blowing of the hot air is alternately changed for every predetermined time.

According to the characterizing feature (6) of the present invention, the hot air is blown toward the linens so that it flows from the outer peripheral part of the linens to the inner peripheral part of the same to heat them. Thus, the linens located at the outer peripheral part of the linen layer is dried faster than those at the inner peripheral part of the same. Next, when the peripheral direction of blowing of the hot air is changed to the axial direction and vice versa, the hot air is caused to flow from the central part of the rotary drum into the outer peripheral part of the linen layer so that the linens at the outer peripheral part of the linen layer are dried faster than those at the central part of the rotary drum. Proper alternation of the directions of blowing of the hot air leads to a result that the linens in the rotary drum can be uniformly dried within a short period of time.

Consequently, the apparatus including the characterizing feature (6) assures that linens can be uniformly dried within a short period of time at a high thermal efficiency using a rotary drum having a small volume of loading capacity by blowing hot air in both axial and peripheral directions while alternately changing the directions, even when the rotary drum is charged with an excessive quantity of linens in excess of the standard quantity of load.

(7) Further, the present invention provides a drum type washing apparatus including a rotary drum made of a perforated plate to perform at least one step among steps of washing, dewatering and drying the wash in the rotary drum, wherein a peripheral wall of the rotary drum is configured in the form of a wall including a single corrugated portion or a plurality of corrugated portions of which corrugation angle is determined in the range of 90° to 160° while the direction of centrifugal force generated by rotation of the rotary drum is involved within the range as defined by the corrugation angle, the rotary drum is rotatably supported within an outer drum, the apparatus is provided with a door for allowing the wash to be introduced into the interior of the rotary drum or discharged therefrom while the door is kept opened, the door being located on the axis of rotation of the rotary drum, and the apparatus is further provided with a hot air blowing nozzle or an air blowing nozzle adapted to blow hot air or air into the interior of the rotary drum, the hot air blowing nozzle or the air blowing nozzle being located above the rotary drum.

The smaller the corrugation angle of the rotary drum, the smaller the water content in linens. In this case, however, the linens tend to come in tight contact with the inner wall surface of the rotary drum. To obviate this malfunction, the apparatus in which steps of washing, dewatering and drying the linens are successively performed without discontinuance should be determined to have a desired corrugation angle. When the corrugation angle is set to the range of 90° to 160°, it is assured that the linens have an uniform water content over the linen layer and an absolute value of water content is reduced. A door through which linens are introduced into the rotary drum or discharged therefrom is opened to introduce them thereinto and a step of washing is then performed by rotation the rotary drum while the door is kept closed. After completion of the step of washing, hot air is blown toward the linens in the rotary drum through a nozzle located above the rotary drum so that tight contact of the linens with the inner wall surface of the rotary drum as is often seen when the rotary drum is rotated at a high rotational speed to perform a step of dewatering can be prevented. Next, the rotary drum is rotated while the door is kept opened. Then, the linens are lifted up away from the inner wall surface of the rotary drum by activating a plurality of beaters and they are then caused to fall down by their own dead weight in the rotary drum so that the step of dewatering is performed. At this moment, air is blown into the interior of the rotary drum through the nozzle so that the linens which have been lifted up in that way can be easily discharged from the rotary drum via the opened door under the effect of force generated by flowing of the air.

The characterizing feature (7) of the present invention offers the following advantageous effects.

1. Reduction of a time required for the step of dewatering:

A water content in linens after completion of a step of dewatering performed under the influence of centrifugal force can be improved remarkably compared with the conventional apparatus and moreover the water content can be uniformly distributed in the rotary drum. This assures that a drying time can be shorted and an occurrence of excessive drying can be prevented. Additionally, tight contact of the linens with the inner wall surface of the rotary drum can be prevented and certain quantity of unbalanced load can be restricted within a region located in the center of weight of the rotary drum.

Accordingly, this characterizing feature is inevitable for allowing a series of steps of washing, dewatering and drying to be successively performed in the rotary drum.

2. Reduction of time required for the step of drying:

(a) The conventional apparatus requires 30 to 40 minutes for performing a step of drying (under a condition that the rotary drum is charged with a rated quantity of load). In contrast with the conventional apparatus, the apparatus of the present invention requires only ½ to ⅔ of the foregoing drying time and this makes it possible to save an energy to be consumed during a period of drying at the same rate corresponding to the above reduction of drying time.

(b) Since the blowing of air in the form of a jet stream is active directly on linens, a loosening effect is additionally given to the linens so that the dried linens can be finished in a soft fashion.

(c) Since air is blown toward the linens in the form of a jet stream and the rotary drum is rotated at a high rotational speed as represented by more or less 1 G, even an excessive quantity of linens in excess of the rated quantity of load by 10 to 20% can be uniformly dried at a high speed.

3. Easy removal of dried linens:

(a) The conventional apparatus requires a high intensity of force for removing linens from the rotary drum. To this end, a young man is usually employed for undertaking the severe task of removal. In contrast with the conventional apparatus, the apparatus of the present invention assures that the dried linens can be discharged from the rotary drum merely by actuating a switch. This makes it possible for a laundrywoman to perform an operation of removal of the dried linens.

(b) A period of time required for removal of the dried linens can be reduced to a level of less than ¼ of that with the conventional apparatus. For example, in a case where 50 Kg of linens are removed from the interior of the rotary drum, the conventional apparatus requires a time longer than 3 minutes after completion of the step of dewatering due to tight contact of the linens with the inner wall surface of the rotary drum. In contrast with the conventional apparatus, the apparatus of the present invention assures that they can be removed therefrom within a period of time shorter than 0.5 minute.

(c) The conventional apparatus requires manual pulling operation for removing linens from the rotary drum, resulting in the linens (particularly, bathrobe, shirt or the like) being often injured or damaged during a period of removing. In contrast with the conventional apparatus, the apparatus of the present invention assures that the foregoing problem can be obviated owing to the fact that the linens are not removed by manual pulling operation.

4. Reduction of a time required for the step of drying:

The conventional apparatus requires a time longer than 80 minutes for completely drying linens which have been washed and dewatered. In contrast with the conventional apparatus, the apparatus of the present invention including the above characterizing features (1) to (3) assures that an operation of drying can be performed for 44 minutes. This means that a time required for the step of drying can be reduced by 45% compared with the conventional apparatus.

(8) Furthermore, the present invention provides a method of processing linens using a drum type washing apparatus including a rotary drum made of a perforated plate to perform at least one step among steps of washing, dewatering and drying linens in the rotary drum, wherein the rotary drum is rotatably supported within an outer drum, the apparatus is provided with a door so as to allow the linens to be introduced into the interior of the rotary drum or discharged therefrom while the door is kept opened, the door being located on the axis of rotation of the rotary drum, the outer drum is provided with an air blowing duct for allowing air to be blown toward the rotary drum therethrough, and after completion of a step of dewatering or after completion of a step of drying, the rotary drum is rotated and at the same time air is blown into the interior of the rotary drum through the duct while the door is kept opened so that the linens in the rotary drum is discharged therefrom to the outside via the door under the effect of force generated by flowing of the air.

(9) Moreover, the present invention provides a method of processing linens using a rotary type washing apparatus including a rotary drum made of a perforated plate to perform at least one step among steps of of washing, dewatering and drying linens in the rotary drum, wherein the rotary drum is rotatably supported within an outer drum, the apparatus is provided with a door so as to allow the linens to be introduced into the interior of the rotary drum or discharged therefrom while the door is kept opened, the door being located on the axis of rotation of the rotary drum, the outer drum is provided with an air blowing duct for allowing air to be blown toward the rotary duct therethrough and an air discharging duct for allowing the waste air to be discharged from the rotary drum to the outside therethrough, the air discharging duct having a damper attached thereto, and after completion of a step of dewatering or after completion of a step of drying, the damper is closed, the rotary drum is then rotated and at the same time air is blown into the interior of the rotary drum through the air blowing duct while the door is kept opened (but the damper is kept closed) so that the linens in the rotary drum are discharged therefrom to the outside via the door under the effect of force generated by flowing of the air.

According to the characterizing features (8) and (9) of the present invention, as the rotary drum is rotated, linens are lifted up away from the inner wall surface of the rotary drum by activating the bearers and they are then caused to fall down by their own dead weight when they are usually lifted up to a level in the angular range of 10 o'clock to 12 o'clock represented by the short pointer of a clock in a case where the rotary drum is rotated in the clockwise direction. At this moment, the door concentrically located at the central part of the rotary drum is kept opened so that air is blown toward the linens from the outer drum. This permits the linens which have been lifted up in the rotary drum in that way to be easily discharged to the outside under the effect of force (air force) generated by flowing of the air from the rotary drum to the outside.

As will be readily apparent from the above description, linens in the rotary drum can be discharged therefrom to the outside under the influence of force generated by flowing of the air whereby removal of the linens can be easily achieved by a laundrywoman. Thus, there does not arise a problem that a young laundryman having a high intensity of power should be employed for removal of the linens from the rotary drum as is the case with the conventional method. In addition, according to the method of the present invention, a period of time required for removal of the linen can be reduced to a level of less than ¼ of that in the conventional method. For example, in a case where 50 Kg of lines are removed from the rotary drum, the conventional method requires a time longer than 3 minutes due to tight contact of the linens with the inner wall surface of the rotary drum after completion of a step of dewatering. In contrast with the conventional method, the method of the present invention requires only a time shorter than 0.5 minute. Further, the conventional method is practiced in such a manner that linens (particularly, bathrobe, shirt or the like) are removed from the rotary drum by manual pulling operation, resulting in the linens being often injured or damages during a period of removal of the linen. In contrast with the conventional method, the method of the present invention does not suffer from such a problem, because no manual pulling operation is required for removing the linens.

BRIEF DESCRIPTION OF THE DRAWINGS

The present invention will be illustrated in the following drawings in which:

FIGS. 1 to 5 illustrate a drum type washing apparatus in accordance with a first embodiment of the present invention, respectively.

FIG. 2 is a vertical sectional view of a rotary drum in accordance with a modified embodiment from the rotary drum in FIG. 1.

FIG. 4 is a cross-sectional view of a rotary drum in accordance with another modified embodiment.

FIG. 5 is a graph illustrating distribution of a water content as viewed toward the central part of the rotary drum with respect to both the apparatus of the present invention and a conventional apparatus.

FIGS. 6 to 10 illustrate a drum type washing apparatus in accordance with a second embodiment of the present invention, respectively.

FIG. 7 is a schematic view illustrating a drum type washing apparatus in accordance with a modified embodiment from the embodiment in FIG. 6.

FIG. 8 is a graph illustrating a relationship between a corrugation angle of the rotary drum and a water content in the linen layer.

FIG. 9 is a graph illustrating a relationship between a corrugation angle of the rotary drum and a peeling force as represented by indexes.

FIG. 10 is a graph illustrating distribution of a water content as viewed toward the central part of the rotary drum.

FIG. 11 is a sectional view illustrating essential components constituting the apparatus.

FIG. 12 is a graph illustrating a relationship between the number of drops of linens and a degree of cleaning in %.

FIG. 13 is a sectional side view of the apparatus in accordance with this embodiment.

FIG. 14 is a cross-sectional view of the apparatus taken in line A—A in FIG. 13.

FIG. 15 is a sectional side view of a drum type washing apparatus in accordance with a modified embodiment from the embodiment shown in FIG. 13.

FIG. 16 is a cross-sectional view of the apparatus taken in line B—B in FIG. 15.

FIG. 17 is a sectional view illustrating essential components constituting the apparatus in accordance with this embodiment.

FIG. 18 is a graph illustrating a relationship between a drying time and a water content in the linens with respect to both the apparatus of the present invention and a conventional apparatus.

FIG. 19 is a sectional side view of the apparatus in accordance with this embodiment.

FIG. 20 is a front view of the apparatus in FIG. 19.

FIG. 21 is a graph illustrating a relationship between a drying time and a water content in linens with respect to both the apparatus of the present invention and a conventional apparatus.

FIGS. 22 and 23 are a schematic view illustrating how the linens in the rotary drum are dried, respectively.

FIG. 24 is a sectional side view illustrating essential components constituting the apparatus in accordance with this embodiment.

FIG. 25 is a front view of the apparatus in FIG. 24.

FIGS. 26 to 28 illustrate a drum type washing apparatus in accordance with a eighth embodiment of the present invention.

FIG. 27 is a front view of the apparatus in FIG. 26(A).

FIG. 28 is a piping system for the apparatus in FIG. 26(A).

DETAILED DESCRIPTION OF THE PREFERRED EMBODIMENTS

Now, the present invention will be described in a greater detail hereinafter with reference to the accompanying drawings which illustrate preferred embodiment thereof.

FIRST EMBODIMENT

First, description will be made below with reference to FIGS. 1 to 4 as to a firt embodiment of the present invention.

FIGS. 1 to 4 illustrate four different types of embodiments associated with the first embodiment of the present invention.

Figure 1A:
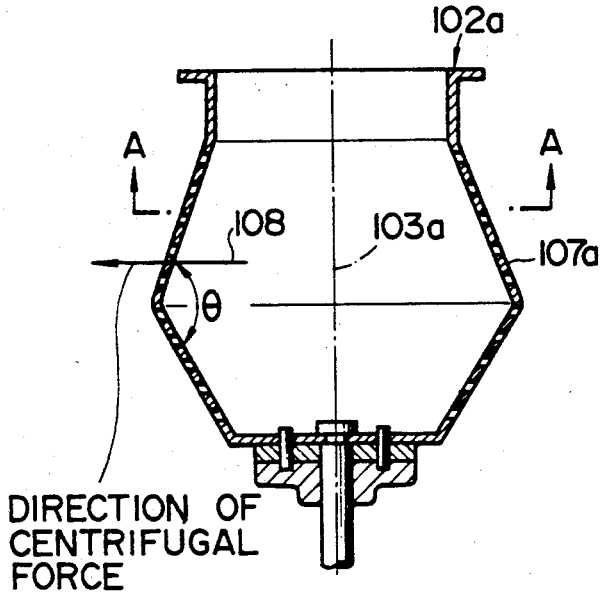
FIG. 1(A) is a vertical sectional view of a rotary drum usable for the apparatus in FIG. 1.
Figure 1B:
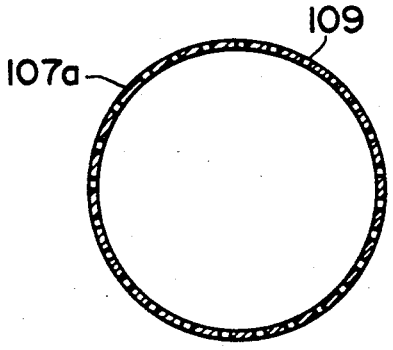
FIG. 1(B) is a cross-sectional view of the rotary drum taken in line A—A in FIG. 1(A).

Specifically, FIG. 1(A) is a sectional side view of a dewatering drum taken along the axis of a driving shaft and FIG. 1(B) is a cross-sectional view of the dewatering drum taken in line A—A in FIG. 1(A).

As will be apparent from the drawings, the dewatering drum 102*a* in accordance with this embodiment exhibits a circular contour as viewed in the horizontal cross-sectional plane located at any position in the vertical direction and it is so configured that a wall 107*a* as viewed in the vertical sectional view taken along an axis line 103*a* of rotation extends while defining a predetermined angle relative to the axis line 103*a* of rotation. In the illustrated embodiment, the whole dewatering drum 102*a* exhibits a pot-shaped contour which is increasingly expanded toward the middle part thereof as viewed in the vertical direction.

Figure 2:
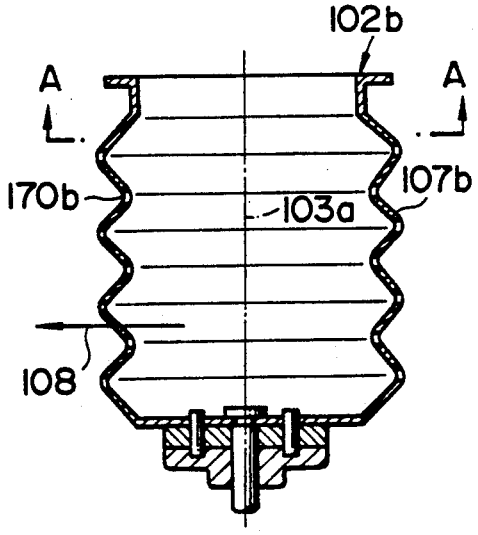

An embodiment shown in FIG. 2 is a modified embodiment from the embodiment in FIG. 1. The wall surface 107*b* of the dewatering drum 102*b* is alternately formed with a plurality of expanded parts and a plurality of constricted parts so that a number of holes 170*b* are drilled round apex surfaces of the respective expanded parts as well as round bottom surfaces of the respective constricted parts.

With respect to the dewatering drums 102*a* and 102*b* shown in FIGS. 1 and 2, the direction 108 of centrifugal force intersects the wall 107*a*, 107*b* at right angles as viewed in the peripheral direction but the wall 107*a*, 107*b* extends in the vertical direction while defining a predetermined angle relative to the direction 108 of centrifugal force. With this construction, although liquid in the drum comes in close contact with the wall 107*a*, 107*b* under the influence of centrifugal force during a period of dewatering, an extra quantity of centrifugal force acts on the liquid so that the latter is easy to move along the wall until it reaches the holes to be discharged outwardly of the dewatering drum.

Figure 3A:
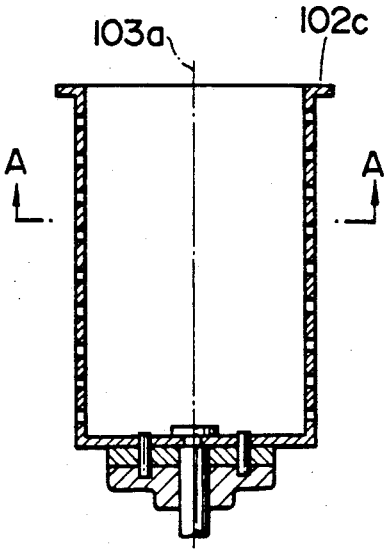
FIG. 3(A) is a vertical sectional view of a rotary drum in accordance with other modified embodiment.
Figure 3B:
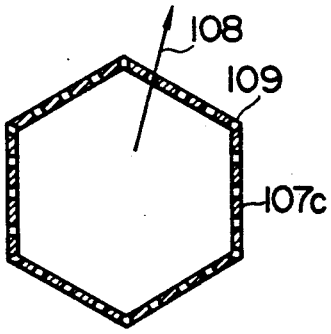
FIG. 3(B) is a cross-sectional view of the rotary drum taken in line A—A in FIG. 3(A).

FIG. 3 illustrates a dewatering drum in accordance with another embodiment wherein FIG. 3(A) is a sectional side view and FIG. 3(B) is a cross-sectional view of the dewatering drum. As will be apparent from the drawings, the dewatering drum 102*c* has a wall 107*c* which exhibits a hexagonal column-shaped contour. A large number of holes 109 are drilled through respective apex portions and flat plane portions on the wall 107*c*. Consequently, the direction 108 of centrifugal force intersects the wall 107*c* at right angles and the latter extends while defining a predetermined angle as viewed in the direction of rotation so that liquid in the dewatering drum 102*c* is easy to move on the wall 107*c* in the direction of rotation, resulting in dewatering being smoothly achieved in the same manner as in the foregoing embodiments.

Figure 4:
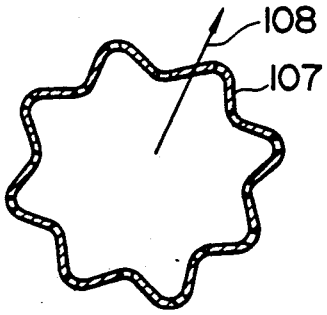

FIG. 4 illustrate a modified embodiment from the embodiment shown in FIG. 3 in which the wall 107*d* as viewed in the horizontal cross-sectional plane exhibits a gear tooth-shaped contour. A large number of holes are formed on apex parts and bottom parts of the wall 107*c* as viewed in the vertical direction. In the preceding embodiment as shown in FIG. 3, the dewatering drum has a small amount of area where the wall 107*c* intersects the direction 108 of centrifugal force at right angles but in this embodiment, the whole wall 107*c* does not intersects the direction 108 of centrifugal force at right angles as viewed in the direction of rotation. This enables dewatering to be achieved more effectively than in the preceding embodiment.

Figure 5:
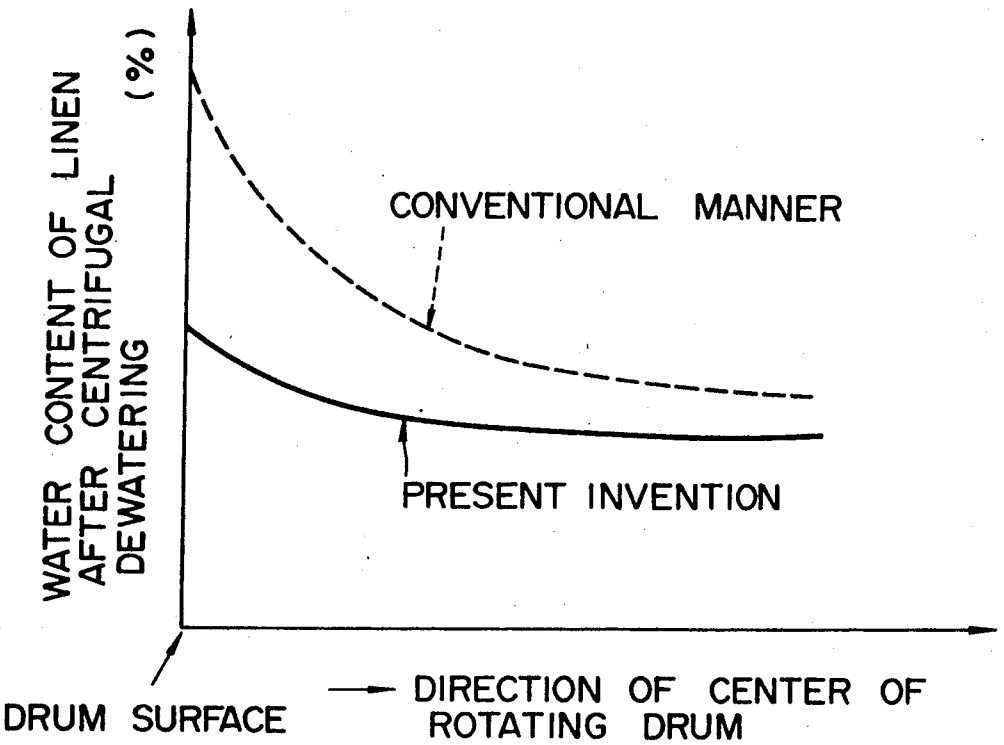

FIG. 5 shows results derived from a number of dewatering tests which were conducted using an apparatus of the present invention in accordance with the substantially same method as mentioned above. A solid line represents results obtained with the apparatus of the present invention, whereas a dotted line does results obtained with a conventional apparatus.

As will be readily understandable form the drawing, the apparatus of the present invention assures that dewatering is satisfactorily performed even for linens (articles to be washed are hereinafter typically represented by linens) located in the proximity of the inner wall surface. Since the diagram shows that a water content of the linens after after completion of dewatering is distributed toward the center of a rotary drum with few fluctuation, this means that an effect of the dewatering has been increased as a whole.

SECOND EMBODIMENT

Figure 6B:
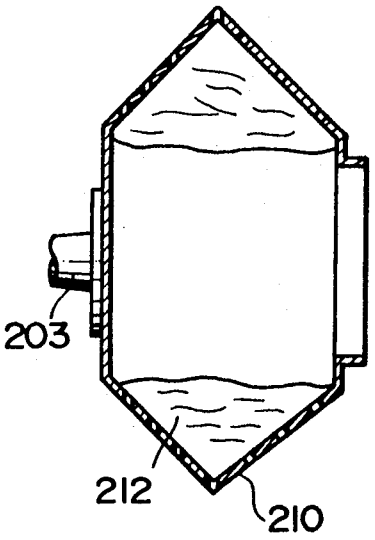
FIG. 6(B) is a sectional view schematically illustrating how linens are brought in contact with the inner wall surface of the rotary drum shown in FIG. 6(A).
Figure 6A:
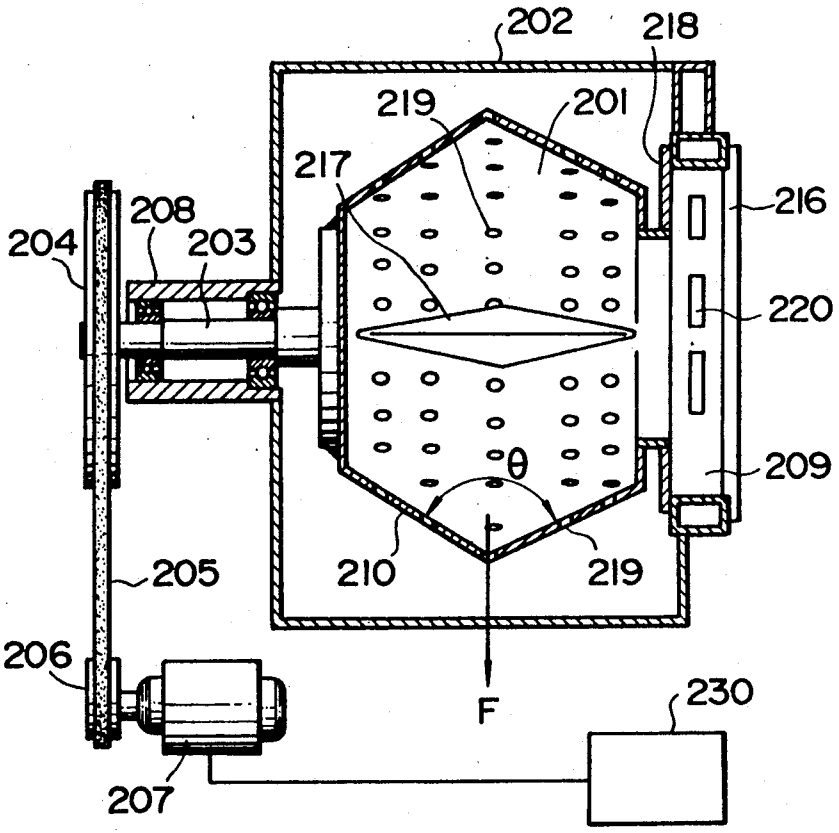
FIG. 6(A) is a sectional view illustrating by way of sectional view essential components constituting the apparatus of the present invention.

FIGS. 1 and 6 illustrate a second embodiment of the present invention.

Figure 8:
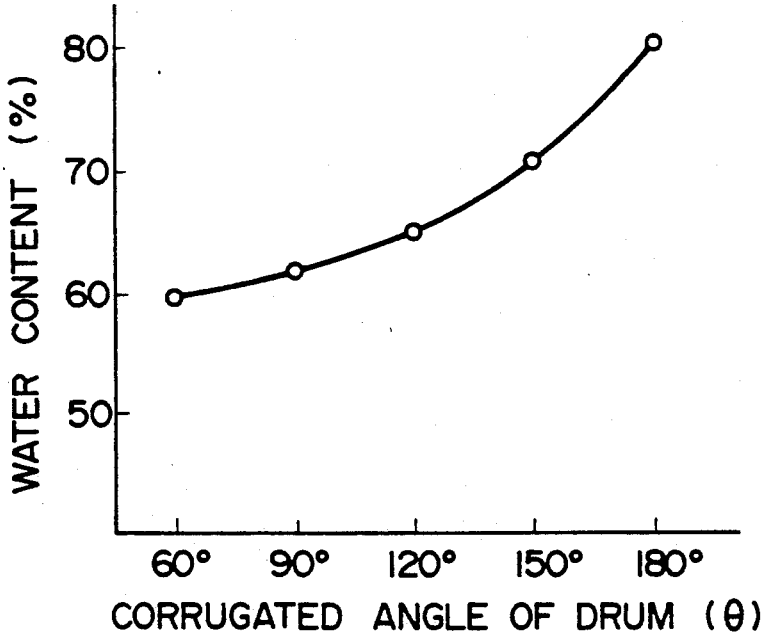
Figure 10:
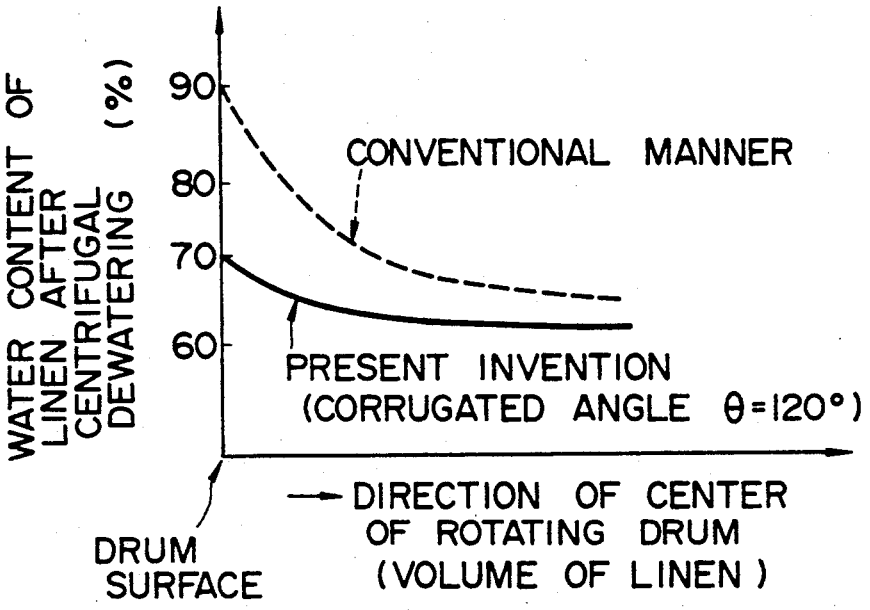

Referring to FIG. 1, the wall 107*a* of the dewatering drum 102*a* extends while defining a so-called corrugation angle $\theta$ (as shown in FIG. 1(A)) relative to the direction 108 of centrifugal direction. FIGS. 8 and 10 show data derived from a number of measurements which were conducted for determining the residual water content in the linen layer while the corrugation angle $\theta$ was varied. In fact, they represent values obtained when the linens were dewatered for 4 minutes under a condition of 350 G. Here, the rotational acceleration as identified by G can be calculated in accordance with the following formula.

$$G = \frac{R}{9.8} \times \left(\frac{2\pi n}{60}\right)^2$$

where R represents a radius of the dewatering drum in meter and n does the number of revolutions of the dewatering drum in rpm.

As shown in FIG. 8, when the corrugated angle $\theta$ is set to 180° as is the case with a conventional flat plate type apparatus, the linen layer has a water content of 80% and when it is set to 120°, it has a water content of 65%. This means that the apparatus of the present invention can remove water from the linen layer by a quantity of 15% more than in the case of the flat plate type conventional apparatus. Further, when the corrugated angle is set to 60°, the linen layer has a water content of 60%. This means that the apparatus of the present invention can improve a property representative of water content by 20% more than the conventional apparatus.

On the other hand, as shown in FIG. 10, the apparatus of the present invention assures that the linen layer located in the proximity of the inner wall surface of the dewatering drum can be sufficiently dewatered and a water content after completion of dewatering is distributed toward the center of the rotary drum with less fluctuation. Accordingly, an effect of the dewatering has been increased as a whole with the apparatus of the present invention.

In contrast with the apparatus of the present invention, the dewatering drum of the conventional apparatus exhibits a large amount of difference in water content between the inner wall surface and the central part thereof. The drawing shows that the conventional apparatus generally exhibits a high water content in such a manner that the linen layer has a water content 90% along the inner wall surface and it has a water content of 65% around the central part.

However, when the corrugation angle $\theta$ of the dewatering drum is set to 120°, the linen layer has a reduced amount of difference in water content between the inner wall surface and the central part of the dewatering drum in such a manner as to have a water content of 70% along the inner wall surface and a water content of 63% around the central part. It should be added that the linen layer has a small amount of water content as a whole and thereby it can be dewatered at a high efficiency.

Figure 9:
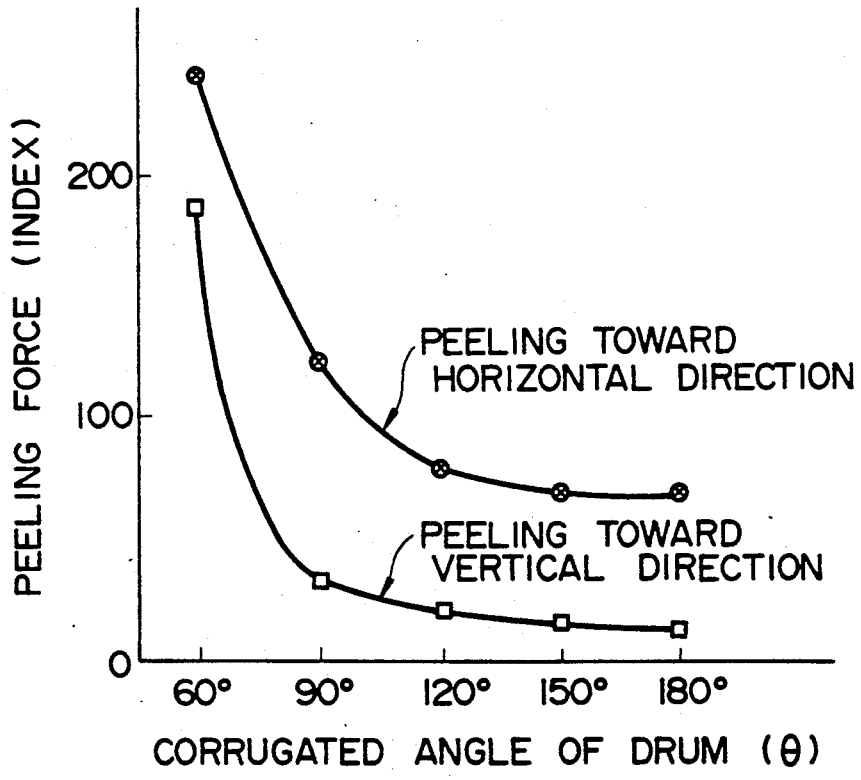

FIG. 9 shows that the linen layer is brought in close contact with the inner wall surface of the dewatering drum when the corrugation angle $\theta$ of the dewatering drum is varied to decrease and moreover it represents in terms of an index a magnitude of peeling force required for removing the linen layer from the wall surface.

In more details, in a case where the corrugated angle is set to 180° (as is the case with the conventional dewatering drum), a peeling force represented by about 10 indexes is required when the linen layer is removed from the inner wall surface in the vertical direction which intersects the direction of centrifugal force toward the inner wall surface of the dewatering drum by right angles (peeling in the vertical direction). When the linen layer is removed therefrom with a peeling force in the horizontal direction which intersects the direction of centrifugal direction also at right angles (peeling in the horizontal direction), it is difficult to remove it in the horizontal direction due to a number of holes 109 drilled through the wall so as to allow water to be discharged therethrough, because it is penetrated into the holes to fill the latter with the linens. In this case, a peeling force as represented by about 70 indexes is required to remove the linen layer from the inner wall surface. When the corrugation angle is set to a smaller angle, e.g., 60°, a peeling force required for removing the linen layer is increase to a level of about 200 or more indexes, e.g., 180 indexes (peeling in the vertical direction) and 240 indexes (peeling in the horizontal direction) in the case shown in the drawing. This causes the linen layer to come in tight contact with the inner wall surface of the dewatering drum. Thus, the linen layer can not be removed therefrom unless a high intensity of force is imparted to it from the outside. Accordingly, the apparatus become impracticable.

To improve a property of water content and suppress an occurrence of tight contact of the linen layer with the inner wall surface of the dewatering drum in view of the foregoing problem, it has been found that the corrugation angle $\theta$ should be detemined in the range of 90° to 160°, preferably 120° to 150° from the viewpoint of practicability.

Next, description will be made below with reference to FIGS. 6 and 7 as to an embodiment wherein steps of washing, dewatering and drying are successively performed using an apparatus including the following components.

201: rotary drum—This is a cylindrical rotary drum which is rotatably supported while a rotational shaft 203 is held in a substantially horizontal state. The rotary drum 201 is driven via a power transmission system comprising a pulley 204 fixedly mounted on the rotational shaft 203, a V-shaped driving belt 205 and a driving pulley 206 fixedly mounted on the output shaft of a motor 207. A number of holes 219 through which air and water flow are formed over the drum wall 210.

202: outer drum—This is arranged outside the rotary drum 201. A drum support 208 comprising a bracket, bearings and so forth is secured to the outer drum 202 at one side of the latter to support the rotational shaft 203. Further, a blowing section 209 for introducing water, steam, hot air and so forth into the interior of the rotary drum 201 is immovably provided on the other side of the rotary drum 201.

203: rotational shaft—This is fixed to the rotary drum 201 so that it serves as a drum driving shaft.

204: pulley—This is a pulley for driving the rotary drum 201, which is fixedly mounted on the rotational shaft 203.

205: belt—This is a belt for transmitting a driving force to rotate the rotary drum 201.

206: pulley—This is fixedly mounted on the output shaft of a motor 207 so that a rotational force generated by the motor 207 is transmitted to the rotational shaft 203 via the pulley 206, the belt 205 and the pulley 204.

207: motor—This is a power supply source for driving the rotary drum 201. The number of revolutions of the motors 207 is determined by a speed changing unit 230.

208: drum support—This comprises a bracket, bearings an so forth so that the rotational shaft 203 is rotatably supported for the rotary drum 201.

209: blowing section—This is secured to the inlet portion of the outer drum 202 so as allow water, steam, hot air and so forth to be introduced into the interior of the rotary drum 201. It has a ring-shaped contour and it is formed with a plurality of openings 201 round the inner peripheral surface. It is so constructed that water, steam and heating medium such as hot air or the like which have been introduced in that way do not leak from the rotary drum 201.

210: drum wall—This is a peripheral part of the rotary drum 201. A number of holes 219 are formed over the wall 210 so as to allow air and water to flow therethrough. The wall 210 has a circular contour as viewed in the direction of a sectional plane which extends at right angles relative to the axial direction. As shown in FIG. 6, it defines a corrugated angle 0 when it is taken in the axial direction.

212: linens (articles to be washed)—This represents linens, towels, sheets, shirts or the like which are subjected to washing, dewatering and drying.

Figure 7:
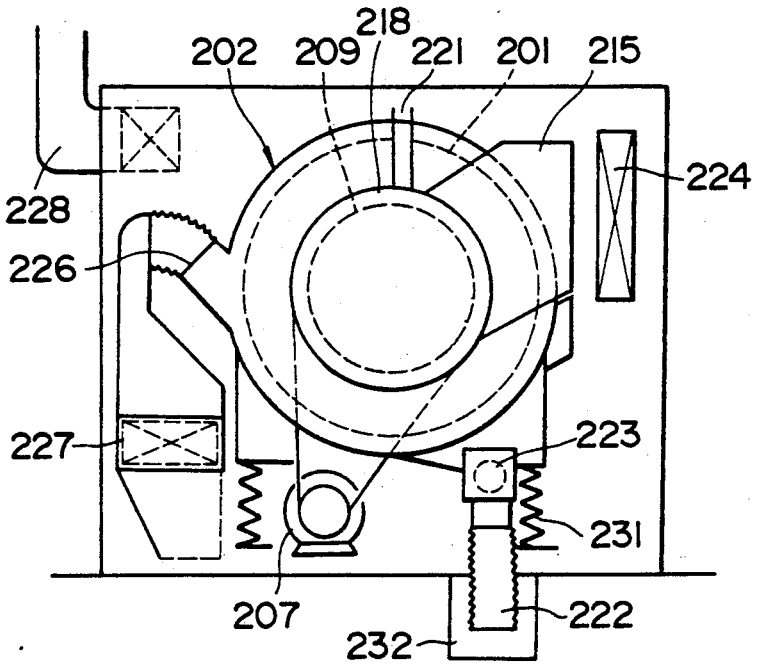

215: duct—As is best seen in FIG. 7, this is secured to the side wall of the outer drum 202 so that hot air is introduced into the interior of the rotary drum 201 therethrough.

216: door—This is opened when linens are introduced into the interior of the rotary drum 201 but it is kept closed during steps of washing, dewatering and drying. The inner wall of the door 216 comes in close contact with the blowing section 209 of the outer drum 202 so that water, steam, hot air and so forth do not leak from the outer drum 201 to the outside.

217: beater—A plurality of beaters 217 are attached to the wall 210 of the rotary drum 201. Each beater 217 has a lozenge-shaped contour and exhibits an effective function for lifting up the linen away from the inner wall surface of the inner wall surface of the rotary drum 201 as the latter is rotated.

218: seal—This is attached to the outer wall surface of the rotary drum 202 so that it comes in slidable contact with the outer peripheral surface 210 of the rotary drum 210. The seal 218 serves to prevent steam, hot air or the like which has been introduced into the interior of the rotary drum 201 via the blowing section 209 from being leaked into the interior of the outer drum 202 while it fails to be introduced into the interior of the rotary drum 201.

219: hole—A number of holes 210 having a diameter of several millimeters are drilled over the wall 210 of the rotary drum 201. During a step of washing, washing water, detergent or the like in the rotary drum 201 flows in the interior of the outer drum 202 through the holes 218 and vice versa.

During a step of dewatering, water separated from the linen is discharged in the interior of the outer drum 202 through the holes 218 as the rotary drum 201 is rotated at a rotational high speed.

During a step of drying, hot air which has been introduced into the interior of the rotary drum 201 carries thermal energy therein for the purpose of drying the linens. After completion of the drying, hot air is discharged in the outer drum 202 through the holes 218. Then, it is discharged further out of the apparatus.

220: opening—Each opening 220 is provided in the form of a rectangular hole which is arranged round the inner peripheral surface of the blowing section 209. Steam and hot air are introduced into the interior of the rotary drum 201 through the openings 220.

221: water supply pipe—This is a conduit through which water is introduced into the interior of the rotary drum 201 for the purpose of performing a step of washing.

222: water discharge pipe—This is used when water is discharged from the outer drum 202 in the course of a step of washing or during a step of washing. A quantity of water to be discharged is controlled by causing a damper 223 to be opened or closed.

223: damper—When water is discharged from the outer drum 202, the damper 223 is opened so that washing water in the outer drum 202 and water separated from the linen are drained from the outer drum 202 in a waste water discharge trench 232 which is located outside the apparatus. When no water is discharged from the outer drum 202, the damper 223 is kept closed.

224: heater—When hot air is to be introduced into the interior of the rotary drum 201, air is sucked by rotating a blower (not shown) installed outside the apparatus while it is heated by the heater 224. The heater 224 is usually constructed in accordance with a system wherein heat carried by steam or hot oil is conducted to the sucked air.

226: exhaust port—This is provided on a location of the outer drum 202 so that air in the outer drum 202 is discharged out of the apparatus therethrough.

227: lint filter—A large amount of waste threads (lints) derived from the linens is involved in the air discharged from the rotary drum 201. The lints in the discharged air can be caught by allowing the air discharged via the exhaust port 226 to flow through the lint filter 227.

228: exhaust duct—This is a duct through which the air having the lints removed therefrom while flowing through the lint filter 225 is discharged out of the apparatus.

230: speed changing unit—This is an unit for adjusting the number of revolutions of the motor 207 as required. It is controlled such that the rotary drum 201 is rotated at an optimum speed during steps of washing and dewatering.

231: vibration proof unit—The rotary drum 201, the outer drum 202 and associated components are mounted on the vibration proof units 231.

232: waste water trench—This is a trench into which the water discharged through the waste water pipe 222 is drained out of the laundry shop.

Next, operation of the apparatus as constituted by the above-mentioned components will be stepwise described below.

WASHING

A predetermined quantity of water is introduced into the interior of the rotary drum 201 and the outer drum 202 via the water supply pipe 221. Since a number of holes 219 are drilled over the wall 210 of the rotary drum 201, water in the rotary drum 201 flows through the holes 219 to be accumulated in the outer drum 202. This causes the water level in the rotary drum 201 to be gradually raised as water is supplied in that way. When it is found by a water level detector (not shown) adapted to detect the existent water level that a predetermined water level is reached, water supply is interrupted. Then, the door 216 is opened so that linens are introduced into the rotary drum 201. The motor 207 is driven to rotate the rotary drum 201 at a predetermined rotational speed. It should be noted that repeated rotation of the rotary drum 201 in both normal and reverse directions is effective for preventing the linens from being entangled with each other.

Detergent and assistant are introduced into the rotary drum 201 from a detergent/assistant supply unit (not shown) so that preliminary washing is performed. On completion of the preliminary washing, the damper 223 is opened to discharge the used washing water in the waste water trench 232 via the water discharge pipe 223. When it is detected by a sensor (not shown) that discharging of the preliminary washing water is completed after a predetermined period of time elapses, the damper 223 is closed.

Next, washing water is introduced into the rotary drum 201 again until a predetermined water level is reached, and detergent and assistant are introduced thereinto from the detergent/assistant supply unit (not shown) in the same manner as mentioned above.

Then, steam is blown into the outer drum 202 through a steam nozzle (not shown) so that washing water is heated up to a predetermined temperature. Rotation of the rotary drum 201 can be changed as required by changing the number of revolutions of the motor 207 under a control of the speed changing unit 230. (It should be added that washing time can be shortened under the effect of mechanical force generated by shock appearing on the water surface as the linens are displaced up and down in the rotary drum 201 by actuating the beaters 217 as well as under the influence of a forcibly increased relative speed of the linens and washing water as seen when the rotary drum 201 is vibrated by a vibrator (not shown).)

Washing is performed in the hot water in the above-described manner and the washing water involved in the linens is then separated therefrom under the effect of centrifugal force generated by rotation of the rotary drum 201 at an intermediate rotational speed. At this moment, the damper 223 of course is kept opened so that the washing water is discharged from the apparatus via the water discharge pipe 222. Thereafter, the damper 223 is closed so that the rotary drum 201 is refilled with water so as to allow a step of rinsing to be executed. The step of rinsing may be executed in the same manner as the step of washing. When the step of rinsing is completed by repeating supply of washing water and discharge of waste water, a next step of dewatering is initiated.

DEWATERING

During a period of dewatering, the rotary drum 201 is rotated while receiving the acceleration as represented by 1 to 1.5 G round the inner wall surface under a control of the speed changing unit 230. This permits the linens in the rotary drum 201 to be substantially uniformly distributed round the inner wall surface. After this operative state has been reached, the rotary drum 201 is in turn rotated at a high speed whereby water in the linens is discharged outwardly of the rotary drum 201 via the holes 219 under the influence of centrifugal force and it is then drained out of the apparatus via the outer drum 202 and water discharge pipe 222.

Here, it should be noted that results derived from a number of tests conducted while the corrugated angle $\theta$ of the rotary drum 201 is varied are as mentioned above with reference to FIGS. 8 to 10. Specifically, when the corrugation angle $\theta$ was set to 60°, the water content of the linens after completion of the dewatering assumed a value of 60% which represents a value by 20% less than that of a conventional apparatus. As shown in FIG. 6(B), the linens were kept in close contact with the inner wall surface of the rotary drum 201 and it was found that the apparatus had a problem that the linens failed to fall down by themselves at the time when the step of dewatering was completed.

To obviate the foregoing problem, the corrugation angle was reset to a value more than 100°. As a result, it was confirmed that after completion of the dewatering the linens fell down by their own dead weight under the influence of some quantity of shock imparted to the linens, e.g., by actuating a brake unit (not shown) during rotation of the rotary drum 201 and then quickly stopping rotation of the same. Accordingly, practicability of the apparatus could be recognized.

Further, in a case of the corrugated type rotary drum as shown in FIG. 6, the linens 212 tend to be displaced in the direction F under the effect of centrifugal force during the step of dewatering until they are accumulated in a portion of the rotary drum 201 having a larger diameter, i.e., the apex portion of the same. Since the corrugated type rotary drum is so constructed that vibration usually caused by the unbalanced load of the linens in the rotary drum during the step of dewatering appears at the center of weight or at a position in the proximity of the latter, it has been found that the step of dewatering can be ideally practiced with a reduced magnitude of vibration.

DRYING

When it is confirmed that the step of dewatering comes near to termination, hot air heated by the heater 224 is introduced into the interior of the rotary drum 201 via the duct 215 and the blowing section 209 so that a step of drying is initiated subsequent to the step of dewatering. If the linens 212 are brought in tight contact with the inner wall surface of the rotary drum 201 as shown in FIG. 6(B), this makes it impossible to uniformly dry the linens 212 within a short period of time using the hot air introduced into the rotary drum 201.

Namely, to assure that washing, dewatering and drying are successively performed via a series of steps, it is essential that after completion of the dewatering the linens 212 can be removed from the inner wall surface of the rotary drum 201 without any necessity for manual operation.

To this end, the number of revolutions of the rotary drum 201 is so determined that an acceleration remains at a level less than 1 G, preferably in the range of 0.7 to 0.8 G. A temperature sensor or a moisture sensor (not shown) is attached to the exhaust port 226 so that completion of the step of drying can be confirmed by detecting that the waste air has reached a predetermined temperature or moisture.

Incidentally, the foregoing embodiment has been described with respect to a case where the rotary drum has a single corrugated portion. However, the present invention should not be limited only to this. Alternatively, it may be applied to a case where the rotary drum has two corrugated portions with the same advantageous effects as those in the preceding case being assured.

Description has been made above as to a case where washing is performed using water. Alternatively, the present invention may be applied to a so-called dry cleaning machine in which washing is performed using organic solvent such as perchloroethylene or the like.

THIRD EMBODIMENT

Figure 11:
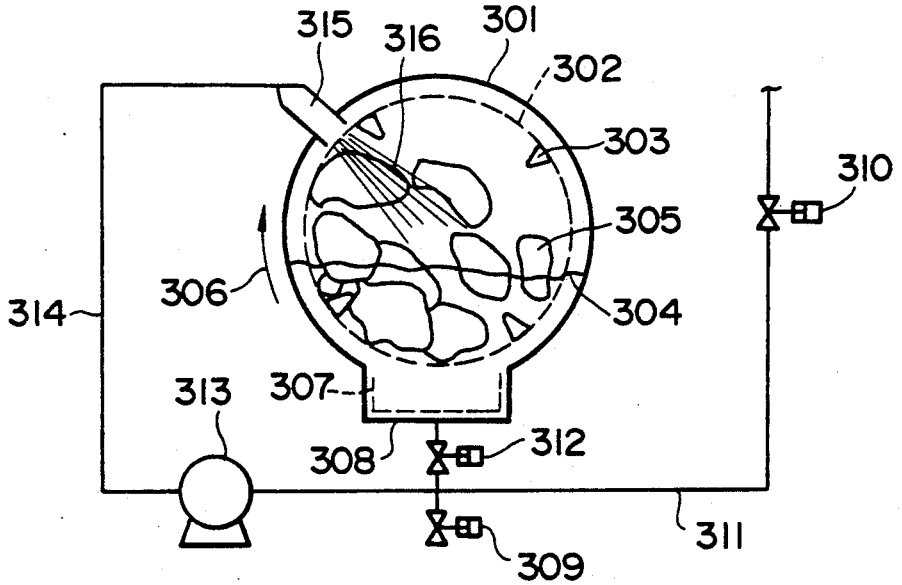
FIGS. 11 and 12 illustrate a drum type washing apparatus in accordance with a third embodiment of the present invention, respectively.

FIG. 11 is a schematic sectional view illustrating essential components constituting a drum type washing apparatus in accordance with a third embodiment of the present invention. Referring to the drawing, the apparatus includes as essential components an outer drum 301, an inner rotary drum 302 having a plurality of beaters 303 each comprising a perforated plate for lifting up linens attached to the inner wall surface thereof, a water pump 313 for supplying the washing water 304 or recirculate the latter and a nozzle 315 for injecting the washing water 304 delivered from the pump 313 to be introduced into the interior of the rotary drum 302 in the form of a jet flow via the perforated plate.

The rotary drum 302 is rotated at a required rotational speed by a motor (not shown) in cooperation with a control unit (not shown).

A water supply piping 311 extends to the suction side of the pump 313 with a water supply valve 310 disposed midway of the piping 311. In addition, a valve 312 serving for both water supplying and water recirculating and a water discharging valve 309 are connected to the piping 311 so that washing water is discharged from the bottom of a filter box 308 in which a filter 307 is accommodated. A recirculating piping 314 is connected to the delivery side of the pump 313 with the nozzle 315 provided at the foremost end thereof.

As is apparent from the drawing, the nozzle 315 is arranged in the proximity of the outer wall surface of the rotary drum 302 in such a manner that it is oriented toward the rotary drum 302 within the angular range of 9 o'clock to 3 o'clock represented by the short pointer of a clock.

A step of washing is practiced in the following manner with the apparatus as constructed in the above-described manner.

(1) Linens 305 to be washed are introduced into the interior of the rotary drum 302 through the opening of a door (not shown) and the rotary drum 302 is then rotated by the motor in cooperation with the control unit in the direction as identified by an arrow mark 306 under a condition of acceleration represented by 0.8 to 1.2 G.

(2) A specified quantity of washing water 304 is supplied to the drum 301 via the water supply valve 310, the water supply piping 311, the pump 318, the recirculating piping 314 and the nozzle 315 or via the water supply valve 310, the water supply piping 311 and the valve 312. At this moment, a quantity of water supplied in that way is controlled by a water level sensor of the float type or the hydraulic pressure type (not shown).

(3) When the drum 301 is filled with a specified quantity of washing water 304, the latter is recirculated via a recirculating system comprising the drum 301, the valve 312, the pump 313, the recirculating piping 14 and the nozzle 314 so that it is injected through the nozzle 314 toward the linens 305 via the perforated plate of the rotary drum 302 to collide with the linens 305 which are lifted up from the inner wall surface of the rotary drum 302 by actuating the beaters 303 as the rotary drum 302 is rotated. Consequently, the linens 305 are impulsively displaced one after another inwardly of the inner wall surface of the rotary drum 302.

(4) After the preceding step as mentioned in the paragraph (3) is executed for a period of time which has been previously determined in accordance with a sequence program or a computor program (not shown), operation of the pump 313 is stopped so that the waste washing water 304 is discharged from the apparatus via the filter 307, the valve 312 and the valve 309.

The present invention has been described above with respect to the drum type washing apparatus in which water is used as washing medium. However, it should be noted that it should not be limited only to this. Alternatively, the present invention may be applied to a so-called dry cleaning machine in which perchloroethylene, trichlorotrifluoroethane (Flon 113), 1.1.1. trichloroethane or petroleum based solvent is used as washing medium with the same advantageous effects as mentioned above being assured.

Figure 12:
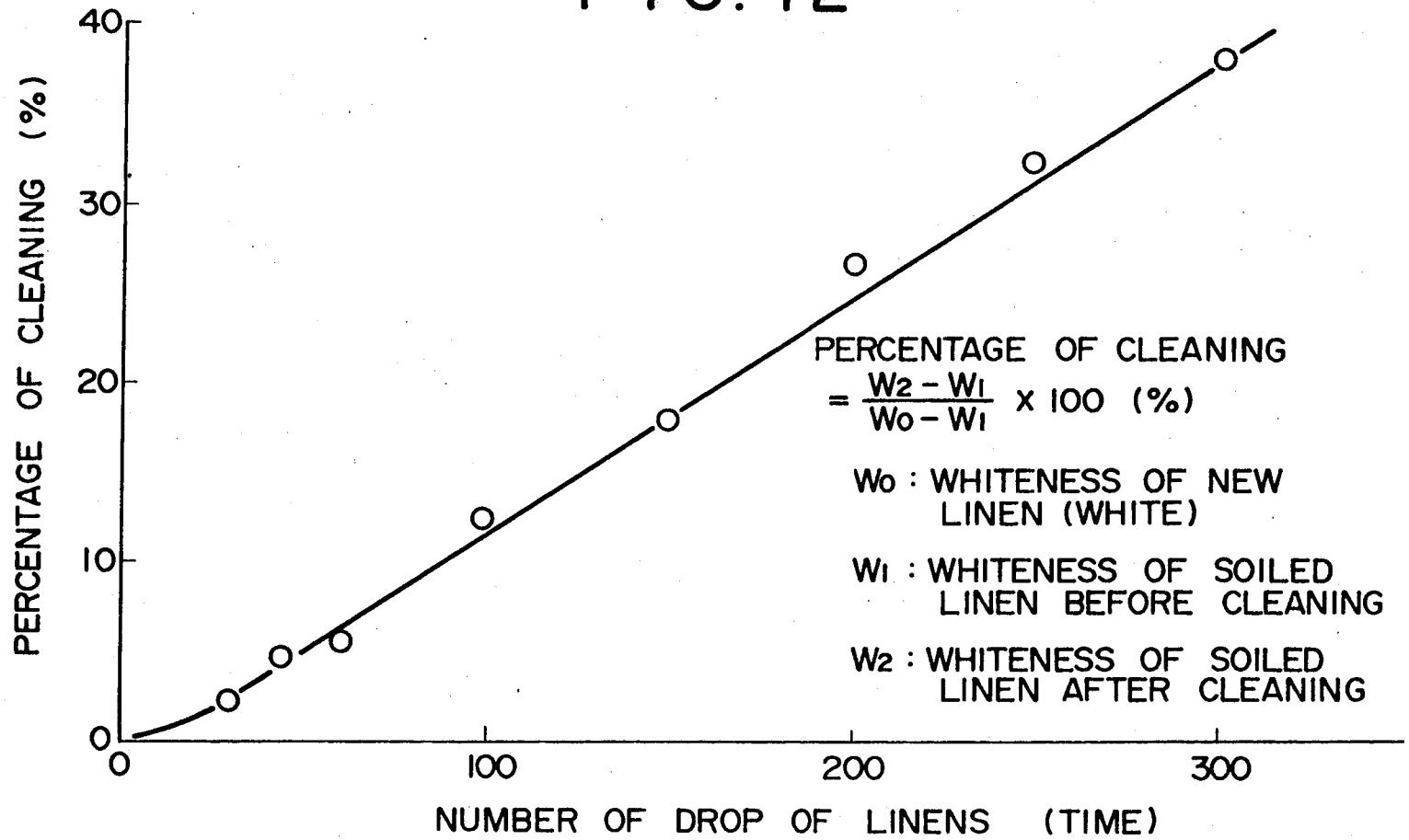

FIG. 12 is a diagram illustrating a relationship between the number of drops of the linen layer having water involved therein from an elevated position having a height of 1.2 m and the cleaning rate in % represented with respect to standard soiled linens (representative of soiled linens specified by Japan Petrochemical Association).

As will be readily apparent from the drawing, the cleaning rate is increased in proportion to increase of the number of drops of the linens. Consequently, the cleaning rate can be increased in proportion to the number of drops of the linens to be performed per unit time.

FOURTH EMBODIMENT

Figure 13:
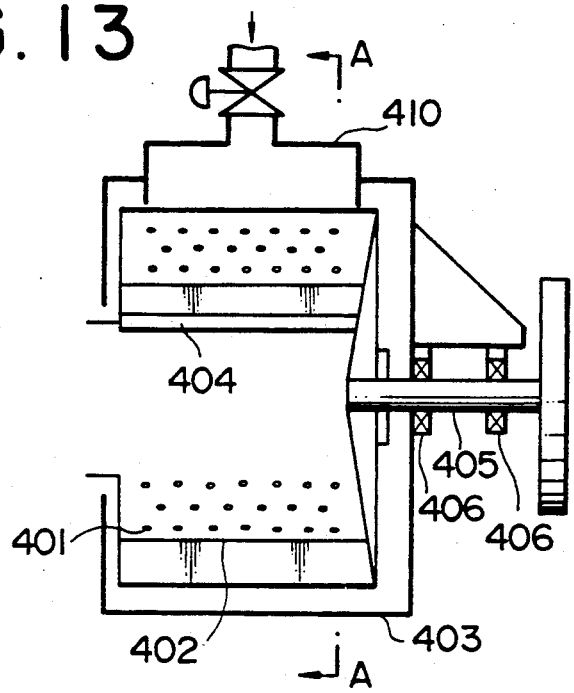
FIG. 13 to 16 illustrate a drum type washing apparatus in accordance with a fourth embodiment of the present invention, respectively.
Figure 14:
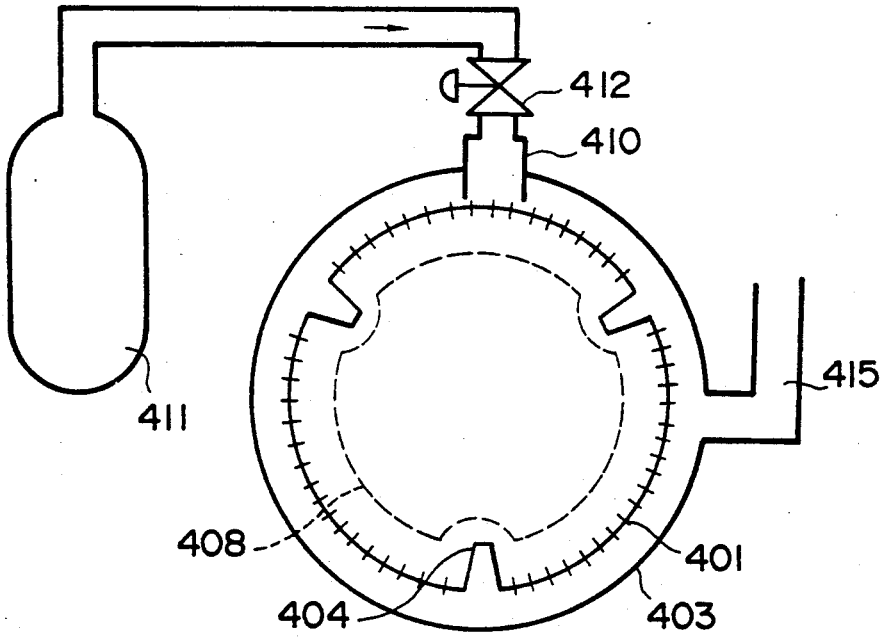

FIG. 13 is a schematic sectional side view illustrating a washing apparatus in accordance with a fourth embodiment of the present invention and FIG. 14 is a cross-sectional view of the apparatus taken in line A—A in FIG. 13.

A rotary drum 402 having a number of holes 401 formed thereon is equipped with a plurality of beaters 404 round the inner wall surface thereof, and it is rotatably supported in an outer drum 403 via bearings 405 adapted to bear a main shaft 405. The outer drum 403 is provided with an air blowing nozzle 410 of which orifice is oriented toward the outer surface of the rotary drum 402. The air blowing nozzle 410 is communicated via an air valve 412 with an air tank 411 installed outside the apparatus so that compressed air in the air tank 411 is blown through the nozzle 410 by opening the air valve 412 and then introduced into the interior of the rotary drum 402 through a number of communication holes 401.

In the illustrated embodiment, the air blowing nozzle 410 is attached to the outer drum 403 at a position located above the outer surface of the latter. Alternatively, it may be attached to the outer drum 403 on the side wall of the latter. In addition, it is essential that a distance between the outer peripheral surface of the rotary drum 402 and the air blowing nozzle 410 is dimensioned as short as possible. The shorter the distance, the smaller the amount of air leaked to the surrounding area. Consequently, air blowing is more effectively performed with the above distance which is determined possibly short.

While the air blowing nozzle 410 is not in use during a step of washing or the like, compressed air is accumulated in the air tank 411 so that it is blown through the air blowing nozzle 410 on or after completion of the dewatering by opening the air valve 412. Incidentally, in the illustrated embodiment a single air tank 411 is installed outside the apparatus. Alternatively, a plurality of air tanks 411 may be installed. The air valve 412 is not necessarily opened one time. It may be opened via plural stages.

The outer drum 403 is provided with an exhaust duct 415 for the purpose of preventing a pressure in the outer drum 403 from being excessively increased at the time when compressed air is blown toward the rotary drum 402. The exhaust duct 415 is not necessarily constructed in a special structure. It may be a simple hole which is opened to the atmosphere.

Next, operations of the apparatus as constructed in the above-described manner after completion of the dewatering will be described below in more details.

(1) Linens are brought in tight contact with the whole inner wall surface of the rotary drum 402, because they are liable to be penetrated into the holes 401 during a period of dewatering.

(2) Compressed air is accumulated in the air tank 411 until air blowing is initiated.

(3) On or after completion of dewatering, the air valve 412 is opened after it is confirmed that the number of revolutions of the rotary drum 402 is reduced to such a level that an acceleration appearing round the outer wall surface of the rotary drum 402 is reduced less than 1 G.

(4) Compressed air in the air tank passes past the air valve 412 so that it is blown toward the outer wall surface of the rotary drum 402 through the air nozzle 412 on the outer drum 403. This causes the linens 408 to be displaced inwardly from the inner wall surface of the rotary drum 402 under the effect of compressed air flowing through the communication holes 401 whereby a gap appears between the linens 408 and the inner wall surface of the rotary drum 402. Thus, the layered structure of the linens 408 is destroyed under the influence of its own dead weight.

(5) The layered structure of the linens 408 can be more easily destroyed at the time as represented in the preceding paragraph (4) by repeating rotation and subsequent interruption of rotation of the rotary drum 402 in both normal and reverse directions.

(6) Air blowing may be performed via plural stages with a plurality of air tanks 411 installed outside the apparatus. Further, air blowing may be performed while the air valve 412 is intermittently opened and closed. With the above performance, more effective air blowing is assured.

(7) As the rotary drum 402 is continuously rotated in both normal and reverse direction while a part of the layered structure of the linens 408 is destroyed, the linens 408 which have been brought in tight contact with the whole inner surface of the rotary drum 402 are parted away therefrom within a short period of time so that the layered structure of the linens 408 is destroyed under the effect of its own dead weight.

(8) After compressed air is blown in that way, it is discharged from the outer drum 403 to the outside via the exhaust duct 415 so that excessive increase of pressure in the outer drum 403 is prevented.

Figure 15:
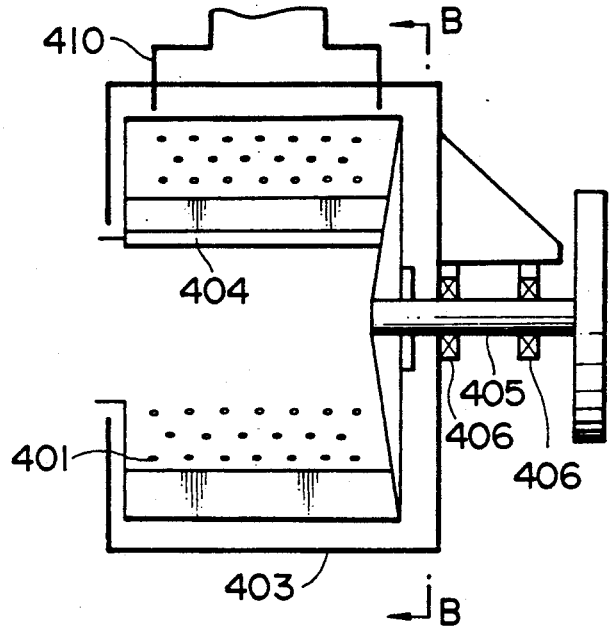
Figure 16:
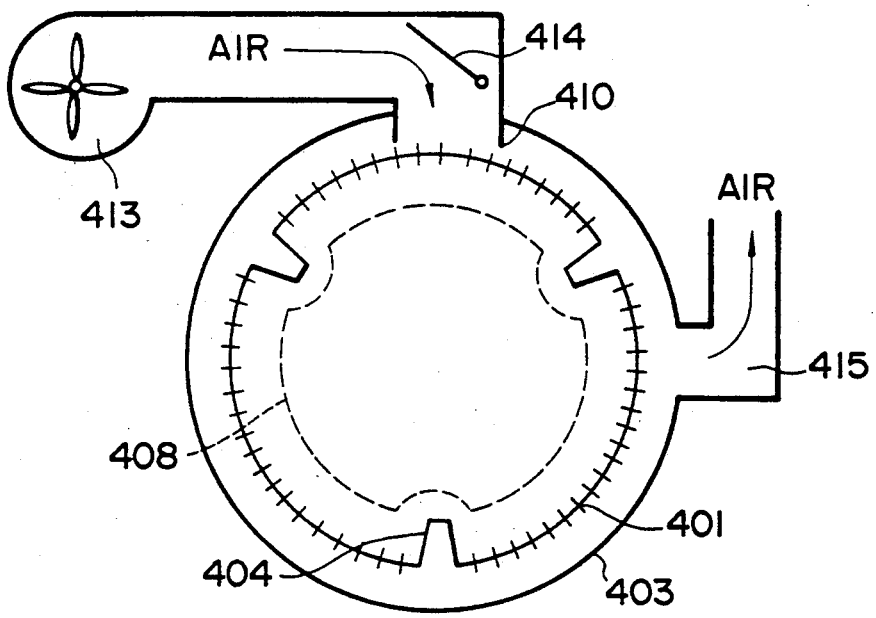

FIG. 15 is a schematic sectional side view illustrating a washing apparatus in accordance with a modified embodiment of the present invention and FIG. 16 is a cross-sectional of the apparatus taken in line B—B in FIG. 15.

In this embodiment, air pressure is continuously generated by rotating a blower 413 instead of compressed air accumulated in the air tank 411. In detail, the apparatus is provided with a blower 410 for blowing toward the rotary drum 402 the environmental air which has been introduced from the outside and compressed by the blower 413. A damper 414 is disposed in the air passage for opening or closing the air duct so that it is opened only at the time when air blowing is performed.

It should be noted that a flow rate of the air conveyed by the blower 413 should be determined more than 0.53 $m^3$/min per unit weight (Kg) of the linens.

Next, operations of the apparatus after completion of a step of dewatering will be described below.

(1) The air damper 414 is opened on or after completion of the dewatering after it is confirmed that the number of revolutions of the rotary drum 401 is reduced to such a level that an acceleration appearing round the outer wall surface of the rotary drum 402 is reduced less than 1 G.

(2) The air conveyed by the blower 413 passes past the air damper 414 and it is then blown toward the outer wall surface of the rotary drum 402 through the air nozzle 410 so that it flows through the communication holes 401 to displace the linens 408 in the inward direction. This causes a gap to be produced between the linens 408 and the inner wall surface of the rotary drum 402, resulting in the layered structure of the linens 408 being destroyed under the influence of its own dead weight.

(3) The layered structure of the linens 408 can be more easily destroyed at the time as represented in the preceding paragraph (2) by repeating rotation and subsequent interruption of rotation of the rotary drum 402 in both normal and reverse directions.

(4) Air blowing may be effectively performed by intermittently opening or closing the air damper 414.

(5) As the rotary drum 402 is continuously rotated in both normal and reverse directions while a part of the layered structure of the linens 408 is destroyed, the linens 408 which have been brought in tight contact with the whole inner wall of the rotary drum 402 are parted away therefrom within a short period of time so that the layered structure of the linens 408 is destroyed under the influence of its own dead weight.

(6) The air blown in that way is discharged from the outer drum 403 to the outside via the exhaust duct 415 so that excessive increase of pressure in the outer drum 403 is prevented.

Incidentally, gas to be blown toward the outer wall surface of the rotary drum 407 should not be limited only to air. Other gas may be used, provided that it is proven that it is suitable for the same purpose.

FIFTH EMBODIMENT

Figure 17:
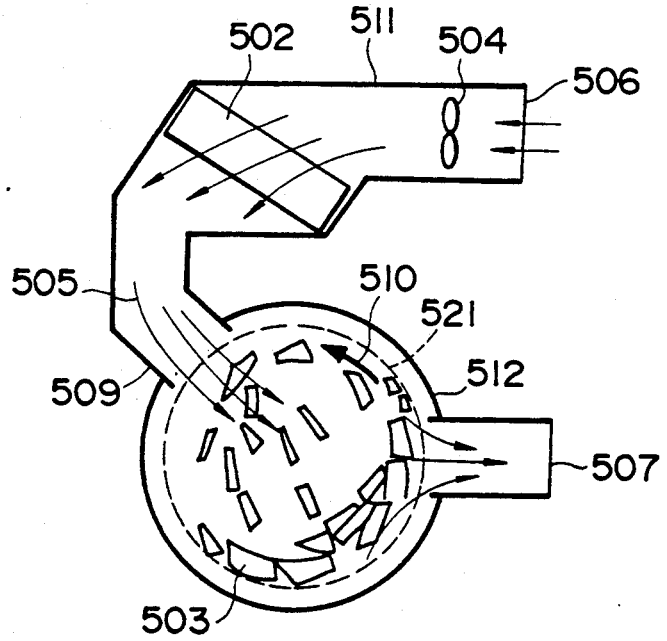
FIGS. 17 and 18 illustrate a drum type washing apparatus in accordance with a fifth embodiment of the present invention, respectively.

FIG. 17 is a schematic sectional view illustrating a washing apparatus in accordance with a fifth embodiment of the present invention.

Referring to the drawing, the apparatus includes an outer drum 512, a rotary drum 521 accommodated in the outer drum 512 and a duct 511 as essential components. As is apparent from the drawing, the rotary drum 521 comprising a perforated plate is rotatably supported in the outer drum 512 via bearings (not shown).

The rotary drum 521 is rotated at a required rotational speed by a motor (not shown) in cooperation with a control unit (not shown).

The outer drum 512 is provided with a blowing nozzle 509 serving as an inlet port of hot air 505 and an exhaust port 507 serving as an outlet port of the hot air 505. The blowing nozzle 509 is arranged in such a manner that it is oriented toward the central of the rotary drum 521 while preferably assuming an angle within the range of 9 o'clock to 12 o'clock or 12 o'clock to 3 o'clock as represented by the short pointer of a clock. On the other hand, the exhaust port 507 is arranged in correspondence to the blowing nozzle 509, while preferably assuming an angle within the range of 2 o'clock to 6 o'clock or 6 o'clock to 10 o'clock as represented in the same manner as mentioned above.

The duct 511 includes an air intake port 506, a blower 504, an air heater 502 adapted to be heated by steam jackets or the like means and a blowing nozzle 509 attached to the outer drum 512, wherein they are successively arranged as viewed in the direction of flowing of the air. It should be noted that an orifice area of the blowing nozzle 509 is so designed that the blown hot air has a speed higher than at least 5 m/sec.

Next, operations of the apparatus as constructed in the above-mentioned manner will be described below.

(1) Linens 503 which have been introduced into the interior of the rotary drum 521 are lifted up away from the inner wall surface of the rotary drum 521 to move round the same as the rotary drum 521 is rotated in the direction as identified by an arrow mark 510 by a motor (not shown) in cooperation with a control unit (not shown) under a condition of acceleration as represented by 0.8 to 1.2 G.

(2) On the other hand, air which has been sucked by the blower 504 is heated up to an elevated temperature in the range of 110° C. to 140° C. by the air heater 502 so that it is blown directly to the linens 503 through the blowing nozzle 509 via the holes on the perforated plate of the rotary drum 521 in the form of a jet stream having a speed higher than 5 m/sec.

(3) The linens 503 distributed in the proximity of the wall (perforated plate) of the rotary drum 521 are blown away toward the central part of the rotary drum 521 by the hot air 505 flowing in the form of a jet stream.

(4) The hot air 505 which has been blown over the linens 503 passes through the layered structure of the linens 503 which are brought in tight contact with the inner wall surface of the rotary drum 521 by rotation of the latter and thereafter it is discharged to the outside via the exhaust duct 507.

(5) The steps as mentioned in the foregoing paragraphs (1) to (4) are successively executed as the rotary drum 503 is rotated whereby a step of drying the linens 503 proceeds.

The aforementioned steps represent fundamental steps to be executed in accordance with the present invention. To facilitate understanding of the present invention, important features of the present invention will be described below in more details.

Figure 18:
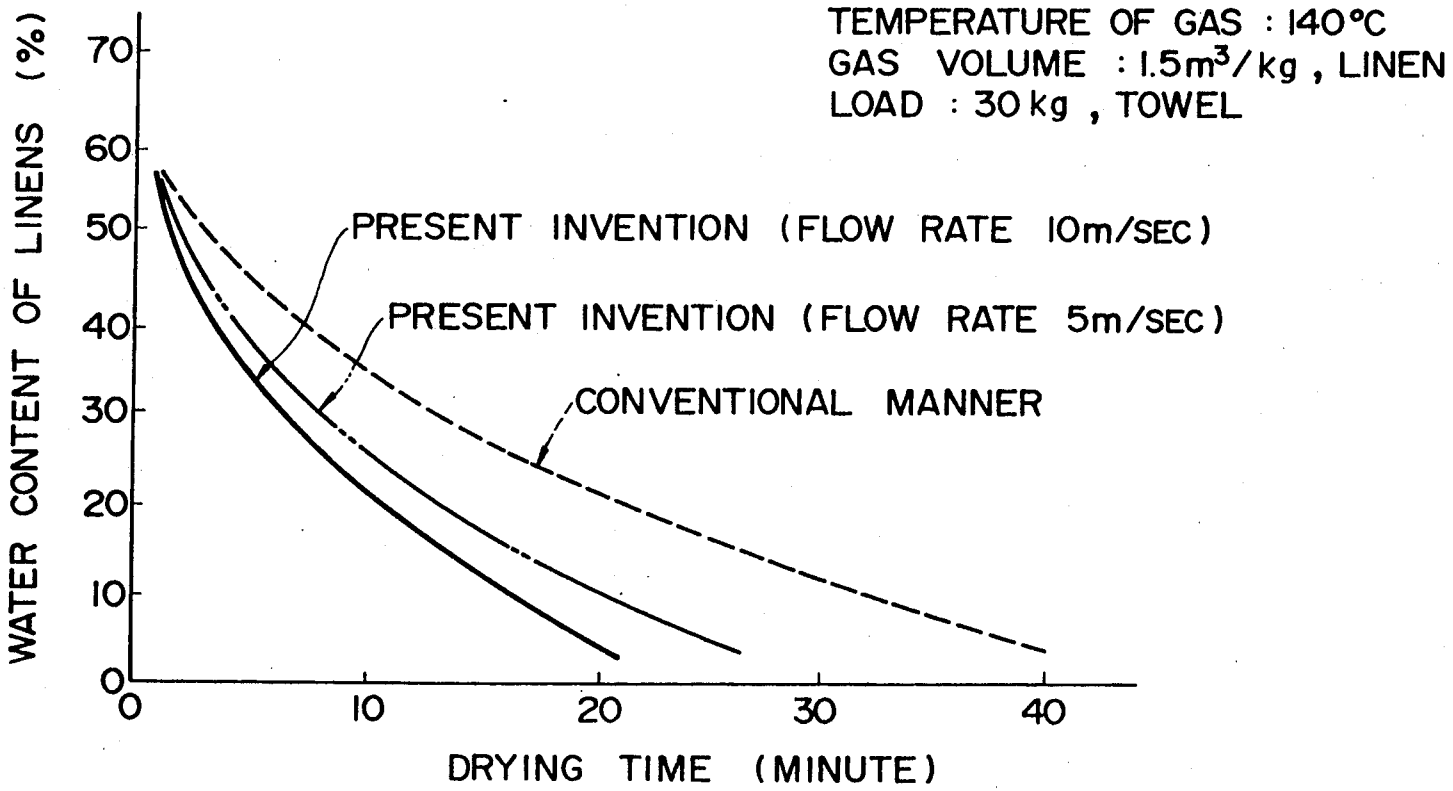

FIG. 18 is a diagram illustrating a comparison of a conventional suction type method of drying linens using an uniform flow of hot air with a blowing type method of drying linens using a jet flow of hot air in accordance with the present invention wherein the comparison is made using a relationshipe between drying time and water content of the linens on the basis of an identical flow rate of hot air. As is apparent from the drawing, the method of the present invention assures that a drying time can be reduced to ½ to ⅔ compared with the conventional method.

This means that a relationship as represented by $R=KG^{0.7}$ to $KG^{0.8}$ is established from the viewpoint of engineering in the art when it is assumed that a drying speed is identified by R and a flowing speed of hot air by weight is identified by G and that the drying rate R can be increased by increasing a relative speed of the hot air to the linens, i.e., G.

In addition, according to a hitherto known report, the drying speed can be increased by ten times by changing the use of a hot air flowing in the form of a laminar flow to the use of a hot air flowing in the form of a jet flow when the linens 503 are dried while they are placed on a flat plane. Thus, it has been found that employment of a hot air flowing in the form of a jet flow is very effective for drying linens at a high speed.

Next, with respect to the number of revolutions of the rotary drum 521, it is preferable that it is determined within the range as represented by 0.7 to 0.8 G when the conventional method is employed, as mentioned above.

Since the number of revolutions of the rotary drum 521 has a direct effect on a frequency of agitations or replacements of the linens 503 in the rotary drums 521, it is advantageous that it is increased more and more. However, it has an upper limit as represented by 0.7 to 0.8 G, when the conventional method is employed. This is because of the fact that when it is in excess of 0.8 G, the linens 503 tend to get together in the proximity of the inner wall surface of the rotary drum 521 and thereby it become difficult to allow the linens 503 to fall down by their own dead weight even when they are located at the uppermost position in the rotary drum 521. Moreover, the linens 503 are agitated at a reduced efficiency.

On the contrary, the method in accordance with the present invention has an advantageous effect that the linens 503 which are brought in tight contact with the inner wall of the rotary drum 521 can be forcibly blown away therefrom toward the central part of the rotary drum 521 under the influence of jet flow of the hot air which has been blown through the blowing nozzle 509. In addition, in contrast with the conventional method, the method of the present invention has no limit concerning the number of revolutions of the rotary drum 521. Thus, even when the rotary drum 521 is rotated at a high rotational speed in excess of 1 G, the linens can be sufficiently agitated at an increased efficiency as the number of revolutions of the rotary drum 521 is increased.

As will be readily understood from the above description, a combination of the blowing blower 504 with the blowing nozzle 509 assures that the hot air 505 is blown in the form of a jet flow and moreover it becomes possible to reduce a drying time remarkably with the result that an energy required for drying can be saved substantially by the foregoing reduction of the drying time (in approximate proportion to the reduced drying time).

Further, even when linens having a quantity by 10 to 20% more than that equal to a magnitude of rated load which is determined on the basis of a size of the rotary drum (in accordance with the method which was prescribed and specified by Japan Industrial Machinery Manufacturer Association) are charged in the rotary drum, they can be uniformly dried within a short period of time.

Additionally, it is required that the position where the exhaust port 507 is provided is properly taken into account in association with the position where the blowing nozzle 509 is provided. This is intended to take into account the provision of the exhaust port 507 and the blowing nozzle 509 so that the hot air 505 which has been blown toward the linens 503 in the form of a jet flow passes through the layered structure of the linens 503 and is then discharged to the outside from the apparatus without fail. If they are provided at angles other than the angular range as specified above, both a drying speed and an efficiency will be reduced due to short pass of the hot air. In this connection, the direction of rotation of the rotary drum 521 presents an important factor.

For example, in the embodiment as shown in FIG. 17, an optimum angle at which the exhaust port 507 is provided is set within the angular range of 3 o'clock to 5 o'clock represented by the short pointer of a clock in a case where the hot air 505 is blown at an angle of 10 o'clock likewise represented by the short pointer of a clock. In this case, the direction of rotation of the rotary drum 521 is restricted to an anti-clockwise direction. On the other hand, in a case where the rotary drum 521 is rotated in a clockwise direction, an optimum angle at which the exhaust port 507 is provided is determined within the angular range of 5 o'clock to 6 o'clock represented by the short pointer of a clock.

This means that also in a case where the hot air 505 is blown through the blowing nozzle 509 at an angle of 2 o'clock represented in the same way, an optimum angle at which the exhaust port 507 is provided may be determined in view of the symmetrical relationship as seen in leftward/rightward directions to an angle to be derived from a reading of the above description in an inverse fashion.

When an angle at which the hot air 505 is blown toward the linens 503 in the form of a jet flow is determined within the angular range represented by 9 o'clock to 12 o'clock represented by the short pointer of a clock, they can be dried at the same drying property as in a case where a blowing angle is determined to about 10 o'clock represented in the same way. However, when the blowing angle is determined in excess of the foregoing range, it becomes difficult to uniformly distribute the linens 503 in a space as defined by the rotary drum 521, resulting in an ability of drying being reduced.

Incidentally, when the hot air 505 is blown with a blowing angle which is determined within the angular range of 12 o'clock to 3 o'clock represented by the short pointer of a clock, things are completely same with the aforementioned case.

SIXTH EMBODIMENT

Figure 19:
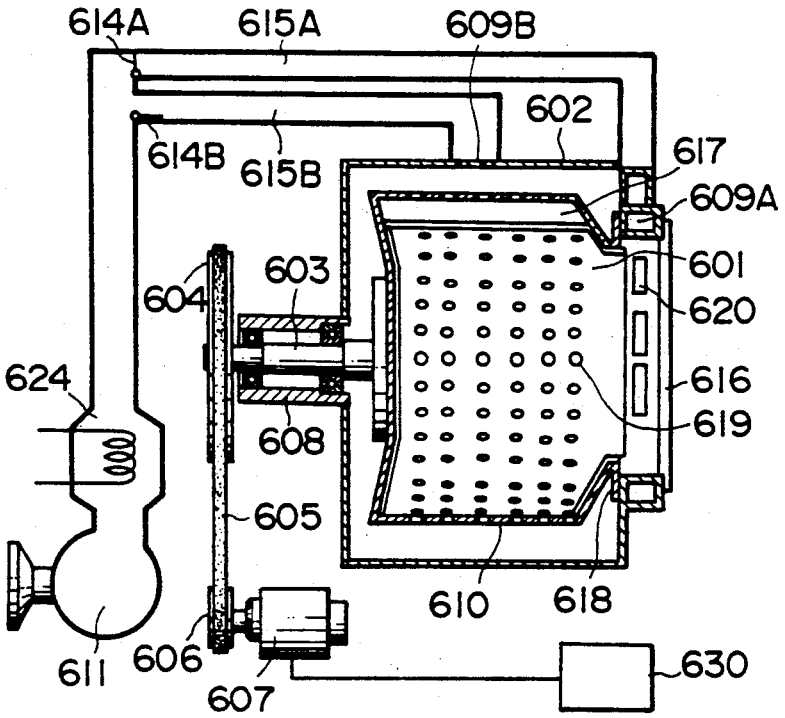
FIGS. 19 to 23 illustrate a drum type washing apparatus in accordance with a sixth embodiment of the present invention, respectively.
Figure 20:
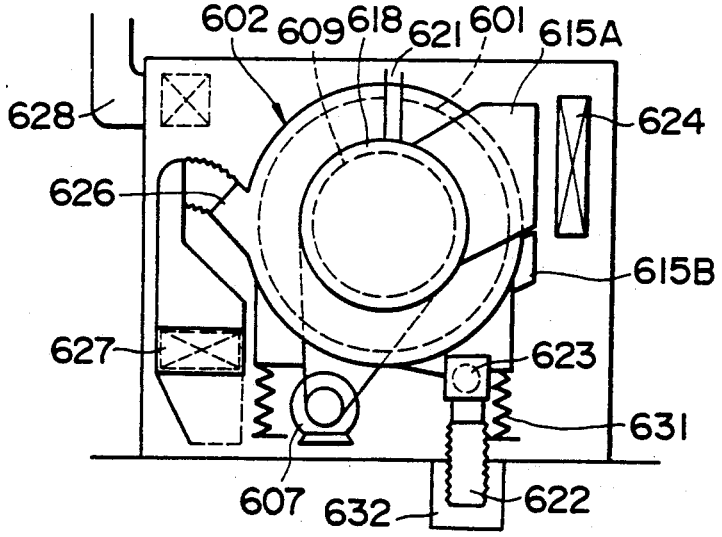

FIGS. 19 and 20 illustrate a washing apparatus in accordance with a sixth embodiment of the present invention. In the drawings, reference numeral 601 designates a rotary drum which is designed in a cylindrical configuration. The rotary drum 601 is rotatably supported while a rotational shaft 603 is held in the substantially horizontal direction so that it is driven via a rotational force transmission system comprising a pulley 603 fixedly mounted on the rotational shaft 603, a V-shaped driving belt 605 and a driving pulley 606 fixedly mounted on the output shaft of a motor 607. A number of holes 619 adapted to allow air and water to flow therethrough are formed over the cylindrical wall of the rotary drum 601. Reference numeral 602 designates an outer drum which is provided outside the rotary drum 601. A drum support 608 comprising a bracket, bearings and so forth for the purpose of supporting the rotational shaft 603 for the rotary drum 601 is attached to one side of the outer drum 602, whereas blowing sections 609A and 609B for introducing water, steam and hot air into the interior of the rotary drum 601 are attached to the other side of the outer drum 602. The rotational shaft 603 is secured to the rotary drum 601 so that it serves as a drum driving shaft. The pulley 604 serves as a pulley for driving the rotary drum 601 and is fixedly mounted on the rotational shaft 603. The motor 607 serves as a power supply source for driving the rotary drum 601, and the number of revolutions of the motor 607 is set by a speed changing unit 630.

The blowing section 609A designed in a ring-shaped contour is secured to the inlet portion of the outer drum 602 so that water, steam and hot air are introduced into the interior of the rotary drum 601. It has an opening 620 formed round the inner periphery thereof. The rotary drum 601 is so constructed that water, steam and hot air introduced thereinto are not leaked to the outside. The blowing section 609B is secured to the side wall of the outer drum 602 so that hot air is introduced into the rotary drum 601. Reference numeral 611 designates a blower adapted to suck air from the outside. The sucked air is heated by a heater 624 and the hot air is then caused to flow past one or both of dampers 614A and 614B which remain in an opened state. The hot air is introduced into the outer drum 602 via ducts 615A and 615B.

Reference numeral 616 designates a door. The door 616 is opened when linens are introduced into the interior of the rotary drum 601, while it is closed during steps of washing, dewatering and drying. The inside wall of the door 616 comes in close contact with the blowing section 609A of the outer drum 602 so that water, steam and hot air are not leaked from the outer drum 602 to the outside. Reference numeral 617 designates a plurality of beaters attached to the inner wall surface of the rotary drum 601. The respective beaters 617 are designed in a lozenge-shaped contour extending in the axial direction and serve to lift up the linens from the inner wall surface of the rotary drum 601 as the latter is rotated. Reference numeral 618 designates a seal attached to the outer drum 602. The seal 618 is adapted to come in slidable contact with the outer wall surface of the rotary drum 601 so that it serves to prevent steam or hot air from being leaked to the outer drum 602 while the steam or hot air fails to be introduced into the interior of the rotary drum 601.

The holes 619 on the cylindrical wall of the rotary drum 601 have a diameter of several millimeters so that washing water and detergent flow therethrough during a step of washing. As the rotary drum 601 is rotated at a high rotational speed during a step of dewatering, water separated from the linens are discharged to the outer drum 602 through the holes 619. During a step of drying, the hot air carries thermal energy in the rotary drum 601 for drying the linens. After it flows in the rotary drum 601 while drying the linens, it is discharged to the outer drum 602 through the holes 619 and it is then discharged therefrom to the outside. Reference numeral 620 designates a plurality of openings in the form of rectangular holes. Steam and hot air are introduced into the rotary drum 601 via the openings 620. It should be noted that hot air is supplied also through the blowing section 609B so that it is introduced into the interior of the rotary drum 601 via the outer drum 602. Reference numeral 621 designates a water supply pipe through which washing water is introduced into the rotary drum 601. Reference numeral 622 designates a water discharge pipe which is used for discharging waste water from the outer drum 602 in the course of a step of washing or during a step of dewatering. Discharging of waste water through the water discharge pipe 622 is controlled by actuating a damper 623. When waste water is discharged from the outer drum 602, the damper 623 is opened so that waste washing water and water separated from the linens during a step of dewatering are discharged from the outer drum 602 via the water discharge pipe 622 and they are then discharged to a waste water discharge trench situated outside the apparatus. Incidentally, the damper 623 is kept closed as long as no water is discharged from the outer drum 602. Reference numeral 624 designates a heater. When hot air is to be introduced into the rotary drum 601, air is sucked from the outside by rotating the blower 611 and it is then delivered to the rotary drum 601 as a hot air after it is heated by the heater 624. Generally, the heater 624 is constructed in accordance with a system wherein air is heated using steam or hot oil.

Reference numeral 626 designates an exhaust port which is provided on a location of the outer drum 602 so as to allow air to be discharged from the outer drum 602 to the outside therethrough. Since a large amount of waste threads (lints) derived from the linens are involved in the air discharged from the rotary drum 626, they are caught by causing the air discharged via the exhaust port 626 to flow through a lint filter 627. Reference numeral 628 designates an exhaust duct through which the waste air having the lints removed in the lint filter 627 is discharged from the apparatus to the outside. The apparatus is provided with a speed changing unit 630 for adjusting a rotational speed of the motor 607. The speed changing unit 630 controls the rotary drum 601 during respective steps of washing, dewatering and drying to assure that the rotary drum 601 is rotated at an optimum rotational speed. Reference numeral 631 designates a vibration proof unit. The rotary drum 601, the outer drum 602 and associated components are mounted on the vibration proof units 631.

Next, operations of the apparatus will be described below.

First, when washing is performed, a predetermined quantity of water is supplied to the rotary drum 601 and the outer drum 602 via the water supply pipe 621. As water introduced into the rotary drum 601 flows through the holes 619 to enter the outer drum 602, a water level in the rotary drum 601 is gradually raised which is monitored by a water level detector (not shown). When a predetermined water level is reached, water supply is interrupted. Next, the door 616 is opened so that linens to be washed are introduced into the interior of the rotary drum 601.

Next, the motor 607 is driven to rotate the rotary drum 601 at a predetermined rotational speed. Incidentally, repeated rotations of the rotary drum 601 in both normal and reverse direction are effective for preventing the linens from being entangled with each other. Next, detergent and assistant are introduced into the rotary drum 601 from a detergent/assistant supply unit (not shown) to perform preliminary washing. On completion of preliminary washing, the damper 623 is opened so that washing water used during a period of preliminary washing is discharged to the waste water discharge trench 632 via the water discharge pipe 622. After a predetermined period of time elapses, completion of discharging of the preliminary washing water is detected by a sensor (not shown) so that the damper 623 is closed in response to a detected result. Next, washing water is introduced into the rotary drum 601 again until a predetermined water level is reached and thereafter detergent and assistant are supplied to the rotary drum 601 from the detergent/assistant supply unit (not shown) in the same manner as mentioned above.

Thus, a steam nozzle (not shown) is activated so as to allow a steam to be blown into water in the outer drum 602 so that the water is heated up to a predetermined temperature. Rotation of the rotary drum 601 can be variably controlled by changing the number of revolutions of the motor 607 under a control of the speed changing unit 630. It should be noted that a period of time required for performing a step of washing can be shortened under the effect of mechanical force generated by a shock appearing over the water surface when the linens are lifted up to the highest level in the interior of the rotary drum 601 in cooperation of the beaters 617 and then caused to fall down therefrom as well as under the influence of a forcibly increased relative speed of the linens and washing water derived from vibratory movement of the rotary drum 601 caused by a vibrator (not shown). In this manner, the linens are normally washed in the hot water and after completion of the step of washing, washing water involved in the linens are separated therefrom under the effect of centrifugal force generated as the rotary drum 601 is rotated at an intermediate rotational speed. At this moment, the damper 623 of course is kept opened so that the waste washing water is discharged from the apparatus via the water discharge pipe 622.

Thereafter, the damper 623 is closed and water is introduced into the rotary drum 601 again to execute a step of rinsing. Incidentally, the step of rinsing may be executed in the same manner as the step of washing. When the step of rinsing is completed by repeating water supply and water discharge by predetermined times, a next step of dewatering is initiated.

Next, description will be made below as a step of dewatering.

During a period of dewatering, the rotary drum 601 is rotated by the motor 607 in cooperation of the speed changing unit 630 under a condition of the acceleration as represented by 1 to 1.5 G which appears along the inner wall surface of the rotary drum 601. This permits the linens in the rotary drum 601 to be substantially uniformly distributed round the inner wall surface of the rotary drum 601. After this operative state has been reached, the rotary drum 601 is then rotated at a higher rotational speed so that water involved in the linens is separated from the latter and then discharged to the outer drum 602 through the holes 610. Then, it is further discharged from the outer drum 602 to the outside via the water discharge pipe 622.

Steam is introduced into the rinsing water through the steam nozzle (not shown) just prior to entering the step of dewatering or in the course of the step of rinsing. This causes the rinsing water to be heated up to an elevated temperature. Consequently, the linens 612 are gradually heated up until a temperature of about 100° C. is reached. Since the surface tension of water is reduced more and more as the water temperature is increased, the result is that an effect of dewatering under the infuleunce of centrifugal force can be increased by about 20%.

Next, description will be made below as to a step of drying.

When the step of dewatering comes near to termination, the damper 614A is opened while the damper 614B is kepy closed. Then, hot air heated by the heater 624 is delivered to the rotary drum 601 via the duct 615A and the blowing section 609A (see FIG. 22). After a predetermined period of time elapses, the damper 614A is closed and the damper 614B is opened so that hot air is introduced into the rotary drum 601 via the duct 615B and the blowing section 609B (se FIG. 23). This enables the linens 612 in the rotary drum 601 to be heated up to an elevated temperature at the central part of the rotary drum 601 as well as along the inner wall surface of the same.

Figure 22:
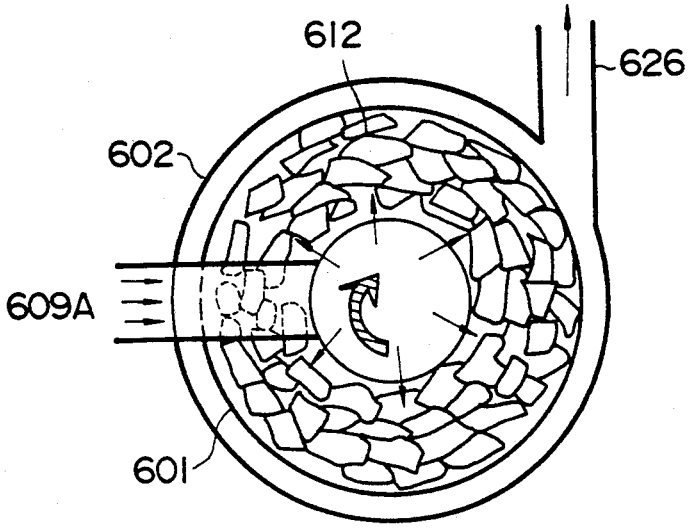
Figure 23:
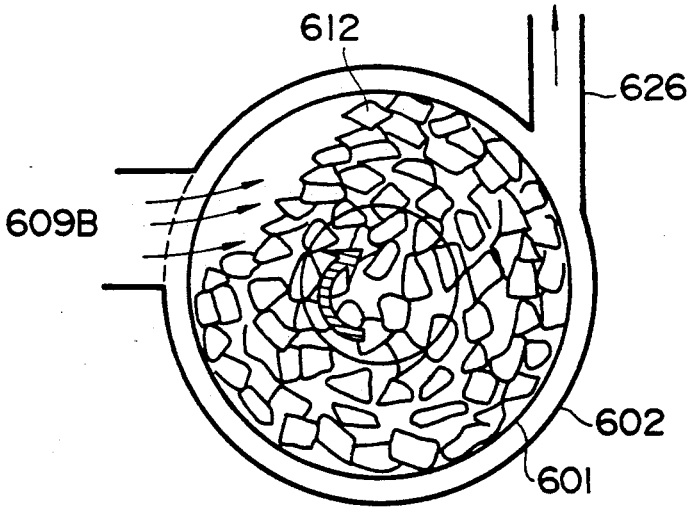

On completion of the step of dewatering, the process goes to a step of drying without any discontinuance. Linens 612 have been introduced into the rotary drum 601 on the assumption that a magnitude of load imparted by the linens 612 is calculated with the apparatus which is considered to serve as a washing/dewatering unit. This makes it possible to increase a magnitude of load to be borne by the rotary drum 601 by about two times as high as a conventional drier when the process goes to the step of drying from the foregoing operative state. Since the linens 612 have bulkiness in a dried state in nature, the rotary drum 601 is substantially fully filled with the linens 612 as shown in FIGS. 22 and 23, resulting in the linens 612 themselves failing to freely move in the rotary drum 601 due to their own dead weight.

Here, description will be made below as to the number of revolutions of the rotary drum 601 which will be represented in terms of a gravity acceleration.

$$G = \frac{R}{9.8} \times \left(\frac{2\pi n}{60}\right)^2$$

where R represents a radius of the rotary drum in meter and n does the number of revolutions of the same in rpm. It should be noted that the number of revolutions of the rotary drum should be determined such that the gravity acceleration is less than 1 G, preferably in the range of 0.7 to 0.8.

A characterizing feature of the present invention consists in that the linens 612 can be uniformly dried within a short period of time even when the rotary drum 601 serving as a drier is charged with an excessive quanity of load more than a normal load specified for a laundry drier (specified for a standard quantity of load by Japan Industrial Machinery Manufacterer Association).

Figure 21:
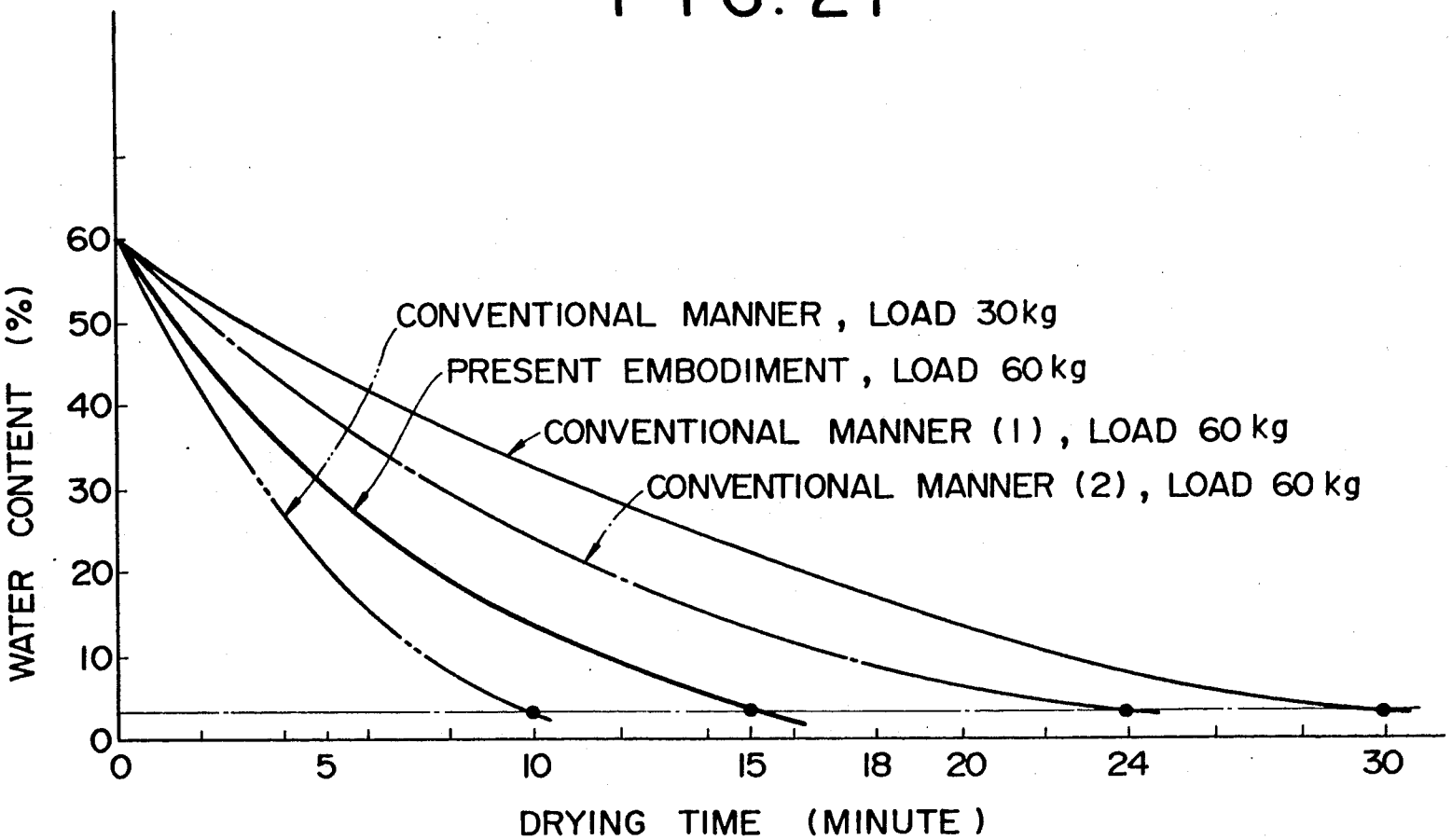
Figure 38:
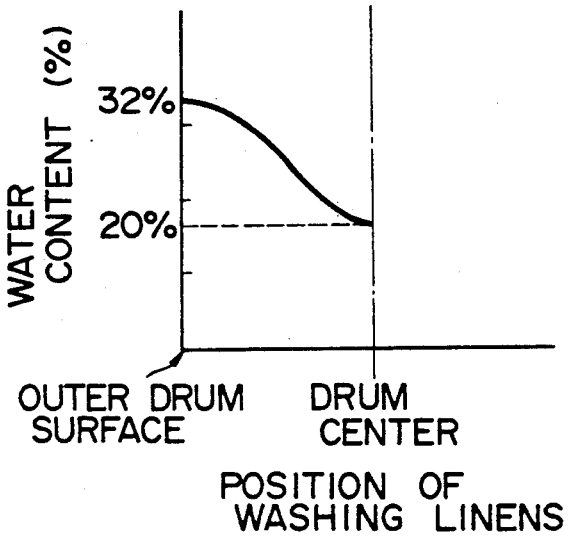
FIG. 38 is a graph illustrating a relationship between a position assumed by linens as viewed toward the central part of a rotary drum and a water content in the linens in a case where a step of washing is performed in accordance with a conventional manner (1) in FIG. 21.

Specifically, as shown in FIG. 22, hot air is first introduced into the interior of the rotary drum 601 via the duct 615A and the blowing section 609A while the damper 614A is kept opened and the damper 614B is kept closed. The linens 612 in the rotary drum 601 are rotated along with the rotary drum 601 while they are appreciably displaced toward the outer drum 602 side under the influence of force generated by flowing of the introduced hot air. After the latter has been used, the waste air is exhausted from the apparatus to the outside via the exhaust port 626 of the outer drum 602. As the step of drying continues while the foreging state is maintained, a difference appears between the water content in the linens 612 at the central part of the rotary drum 601 and the water content in the linens 612 round the inner wall surface of the same, as shown in FIG. 38. As is apparent from the drawing, the linens 612 have a water content round the inner wall surface by about 10% more than that at the central part of the rotary drum 601. Here. it should be noted that this value of water content represents a value as measured when ten minutes elapse after the step of drying is started and that an average value of water content is decreased till termination of the step of drying as time elapse, as represented by the drying characteristic curve derived from a conventional manner (2) shown in FIG. 21.

When the hot air is introduced into the rotary drum 601 via the duct 615B and the blowing section 609B while the damper 614A is kept closed and the damper 614B is kept opened, the linens 612 in the rotary drum 601 are appreciably squeezed within the interior of the rotary drum 601 under the effect of force generated by flowing of the blown hot air, as shown in FIG. 23. When the step of drying continues while this operative state is mainatiend, the result is that the linens 612 located round the inner wall surface of the rotary drum 601 has a water content less than that at the central part of the rotary drum 601. A water content round the inner wall surface and a water content at the central part of the rotary drum 601 are distributed as shown in FIG. 38 which represents that the linens round the inner wall surface of the rotary drum 601 exhibit a value of water content by about 10% more than that at the central part of the rotary drum 601. An average value of water content is decreased as time elapses, as represented by the drying characteristic curve derived from a conventional manner (1) shown in FIG. 21.

According to the present invention, uniformalization of drying and reduction of drying time can be realized by exchanging the blowing of hot air as mentioned above with reference to FIG. 22 with the blowing of hot air as mentioned above with reference to FIG. 23 and vice versa. In this connection, values derived from actual measurements will be as shown below.

dimensions of the rotary drum: 1.3 m in diameter and 0.6 m in width capacity of the blower: 50 $m^3$/min period of exchanging of the blowing of hot air: 3 min time required for executing the step of drying being as shown in the following table

| quantity of linen to be processed | method of the invention | conventional manner (1) (see FIG. 23) | conventional manner (2) (see FIG. 22) |
|---|---|---|---|
| 60 Kg | 15 min | 30 min | 24 min |
| 30 Kg | — | 12 min | 10 min |

where each of the above-noted values of time represents a time that elapses until the linens having a water content of 60% are dried to a level as represented by a water content of 4%. Incidentally, accoring to the current standard specified for a standard quantity of load by Japan Industrial Machinery Manufacturer Association, a rotary drum as mentioned above should be designed in such a manner that it can be charged with 67 Kg of linens when it is used as a washing/dewatering unit and it can be charged with 32 Kg of linens when it is used as a drier. Although a standard quantity of load is specified to 32 Kg when the rotary drum is used as a drier, it has been found that linens can be dried for 15 minutes even when it is excessively charged with 60 Kg of linens. This means that drying can be performed by 1.5 times as long as the standard case where a period of 10 minutes is required for drying 30 Kg of linens. Further, it has been found that the linens in the rotary drum can be dried uniformly. It should be added that in connection with the above-described actual measurements, a capacity of blower practically used therefor was set to a value larger than that derived from the conventional rotary drum in order to assure that a drying time can be shortened.

Further, it has been found that the apparatus of the present invention has an advantageous effect that the linens 612 in the rotary drum can be uniformly dried within a short period of time even when hot air is simultaneously introduced into the interior of the rotary drum 601 for a predetermined period of time in accordance with two manners as shown in FIGS. 22 and 23. Although the present invention has been described above with respect to a case where the step of washing is performed using water, it may be applied to a dry cleaning machine in which an organic solvent such as perchloroethylene or the like is used as a washing medium. Further, the present invention has been described above with respect to the embodiments wherein steps of washing, dewatering and drying are successively executed in a single unit. Alternatively, the present invention may be applied to a drum type drier adapted to serve only as a drier.

SEVENTH EMBODIMENT

Figure 24:
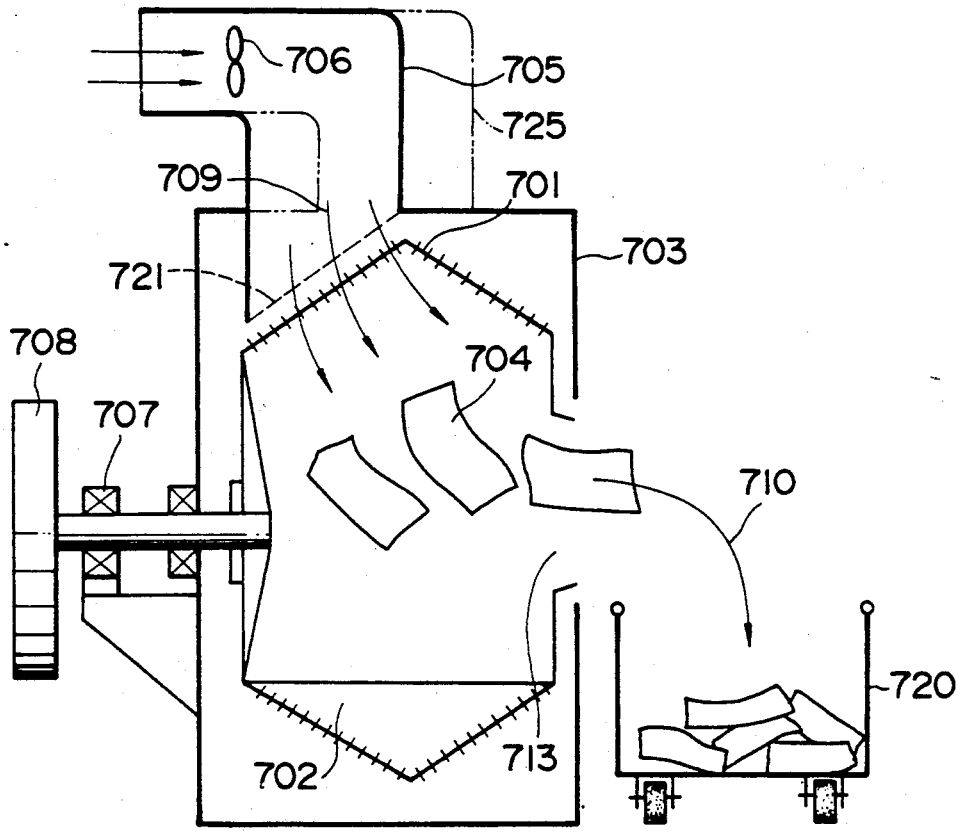
FIGS. 24 and 25 illustrate a drum type washing apparatus in accordance with a seventh embodiment of the present invention.
Figure 25:
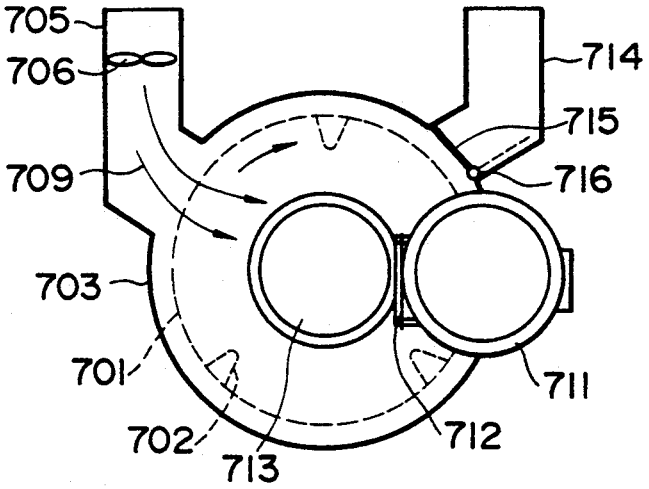

FIG. 24 is a schematic sectional view illustrating essential components constituting a washing apparatus in accordance with a seventh embodiment of the present invention and FIG. 25 is a front view of the apparatus in FIG. 24.

In the drawings, reference numeral 701 designates a rotary drum of which wall is formed with a number of holes. A plurality of beaters 702 are attached to the inner wall surface of the rotary drum 701. It should be noted that the rotary drum 701 exhibits a so-called corrugated type sectional contour as proposed by Japanese Patent Application No. 195164/1986. A rotational shaft secured to the drum 701 and a pulley 708 are rotatably supported via bearings 707 so that the rotary drum 701 is rotated by a driving unit (not shown). As is apparent from the drawings, the rotary drum 701 is accommodated in an outer drum 703 and linens 704 to be washed are introduced into the interior of the rotary 701.

Reference numeral 705 designates a duct which is fixedly secured to the outer drum 703. To blow air into the interior of the rotary drum 701 through a blowing nozzle 721 via the duct 705, a blower 706 is provided in the duct 705. When the air 709 is blown into the rotary drum 701 as the blower 706 is rotated, it is caused to flow in the form of an air stream 710 to the outside through the opening 713 of a door 711 which has been previously opened in a case where an exhaust port is kept closed. Reference numeral 712 designates a pin adapted to serve as a pivotal axis round which the door 711 is turned in opening/closing directions. Reference numeral 714 designates an exhaust duct which is required in a case where steps of washing, dewatering and drying are practiced using a single apparatus. A hole (not shown) adapted to allow waste air to be exhausted to the outside therethrough is formed in a joint portion between the exhaust duct 714 and the outer drum 703, and a damper 715 and a turning axis member 716 are attached to the joint portion to close the hole therewith. The damper 715 is opened or closed by actuating a pneumatic cylinder (not shown) in cooperation with a control unit (not shown). Reference numeral 720 designates a wagon which serves to receive the linens 704 which are discharged from the rotary drum 701 one after another.

Next, operations of the apparatus as constructed in the above-mentioned manner will be described below.

The linens 704 which have been introduced into the rotary drum 701 are subjected to washing and dewatering. During steps of washing and dewatering, the door 711 of course is kept closed to assure that water in the rotary drum 701 is not leaked therefrom to the outside. Namely, the damper 715 is kept closed as shown in FIG. 25 so that no water is scattered to the outside during the steps of washing and dewatering. After completion of the steps of washing and dewatering, the damper 715 is turned to a position as represented by a dotted line by actuating the pneumatic cylinder (not shown) so that the exhaust duct 714 is kept opened. Then, when the blower 706 is rotated and the rotary drum 701 is also rotated, the linens 704 are easily removed away from the inner wall surface of the rotary drum 701.

Next, a heater (not shown) disposed in the duct 705 is activated so that a step of drying is initiated. After completion of the step of drying, the door 711 is opened and the damper 715 is closed (to assume the illustrate state). Then, as the blower 706 is rotated and thereby the hot air 709 is introduced into the rotary drum 701, the linens 704 are easily discharged under the influence of force generated by flowing of the hot air 709 from the rotary drum 701 to the outside through the opening 713 with the door 711 opened to the illustrated position while they are lifted up away from the inner wall surface of the rotary drum 701 under the effect of impulsive force generated by the beaters 702. As the linens 704 are discharged in that way, they are successively received in the wagon 720 which remains in the waiting state as shown in FIG. 24.

Figure 39:
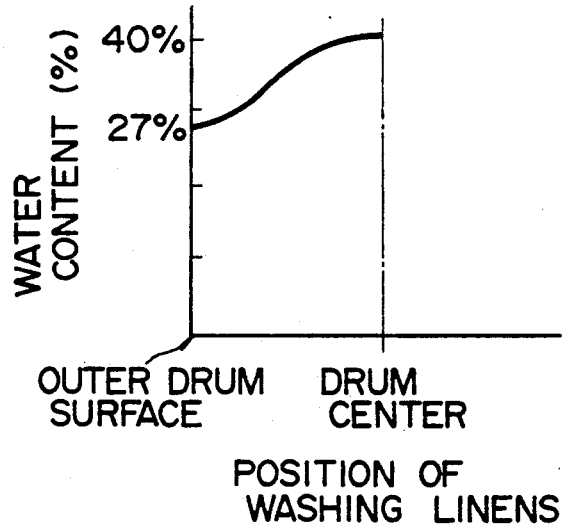
FIG. 39 is a graph similar to FIG. 28, particularly illustrating a case where a step of washing is performed in accordance with another conventional manner (2) in FIG. 21.
Figure 40:
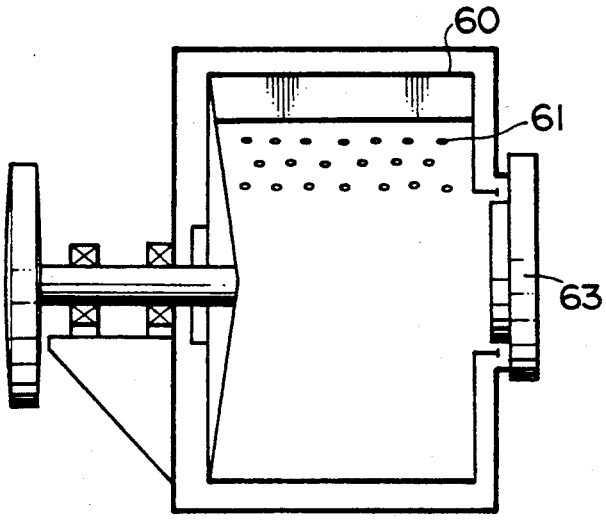
FIG. 40 PRIOR ART
FIG. 40 is a sectional side view of another conventional drum type washing apparatus.
Figure 41:
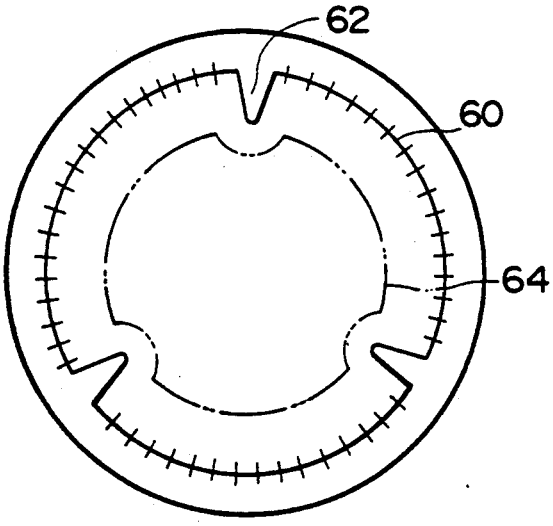
FIG. 41 PRIOR ART
FIG. 41 is a front view of the apparatus in FIG. 40.

The present invention has been described above with respect to the apparatus adapted to perform steps of washing, dewatering and drying. Alternatively, it may be applied to a washing/dewatering unit or a drier. In a case of the washing/dewatering unit, no drying is performed after the linens 704 are removed from the unit via the opening 711 while the door 710 is opened (with damper 715 being kept closed). Description has been made above with reference to FIG. 24 which illustrates that the rotary drum 701 is constructed in the corrugated structure which is intended to prevent the linens 704 from being brought in tight contact with the inner wall surface of the rotary drum 701. Alternatively, the present invention may be effectively applied to a case where the rotary rum is constructed in the cylindrical configuration (as shown in, e.g., FIG. 39). The present invention has been described above as to a case where the apparatus is provided with an exhaust duct 714. Alternatively, it may be likewise applied to the washing/dewatering unit which is not provided with such an exhaust duct, without any loss of automatic discharging effect of the linens 704 from the rotary drum 701. Further, the present invention has been described above as to a case where hot air is introduced into the rotary drum 701 by rotating the blower 706. Alternatively, other method may be used instead of employment of the blower 706, provided that it has been proven that it has the same effects as the foregoing embodiment of the present embodiment. It should be added that instead of the duct 705 a duct 725 may be provided at a position as represented by a two-dot chain line in FIG. 24.

EIGHTH EMBODIMENT

Figure 26A:
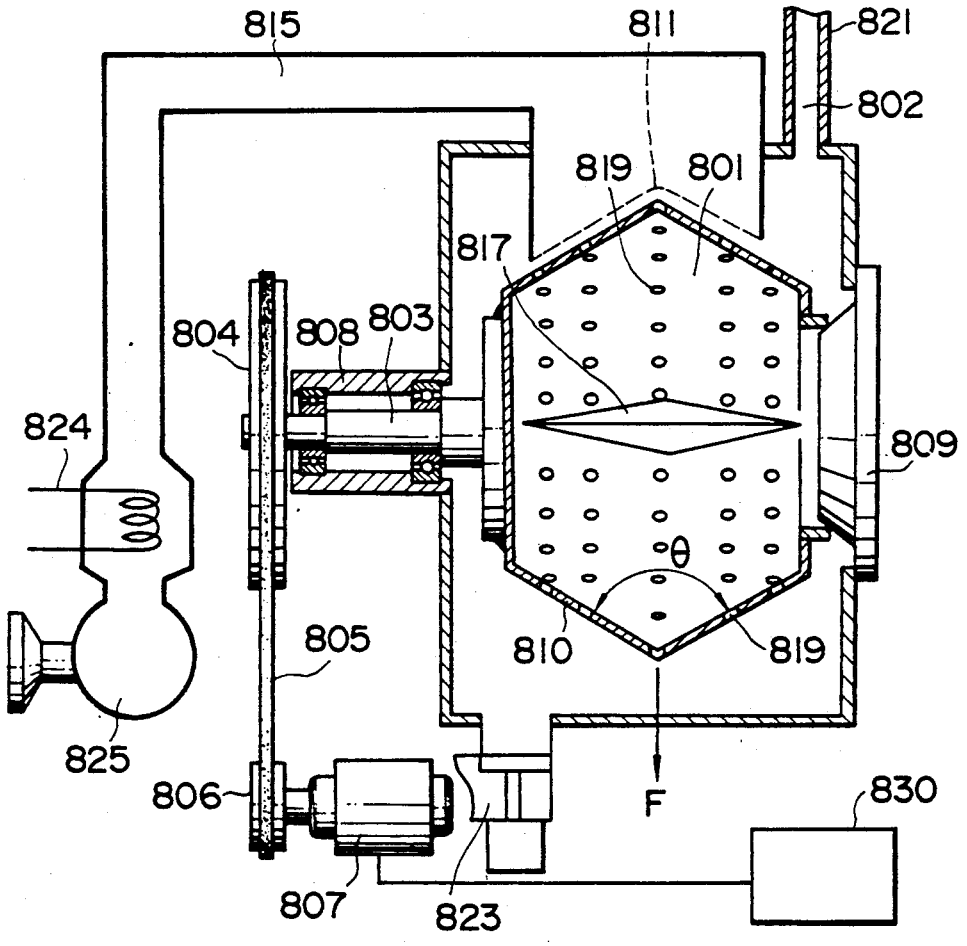
FIG. 26(A) is a sectional side view illustrating essential components constituting the apparatus in accordance with this embodiment.
Figure 26B:
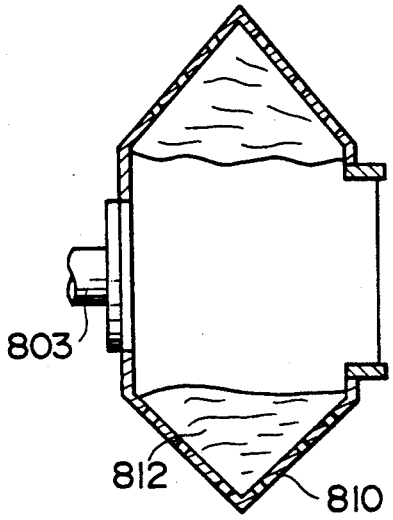
FIG. 26(B) is a sectional view of a rotary drum usable for the apparatus in FIG. 26(A) schematically illustrating how linens are brought in tight contact with the inner wall surface of the rotary drum shown in FIG. 26(A).
Figure 27:
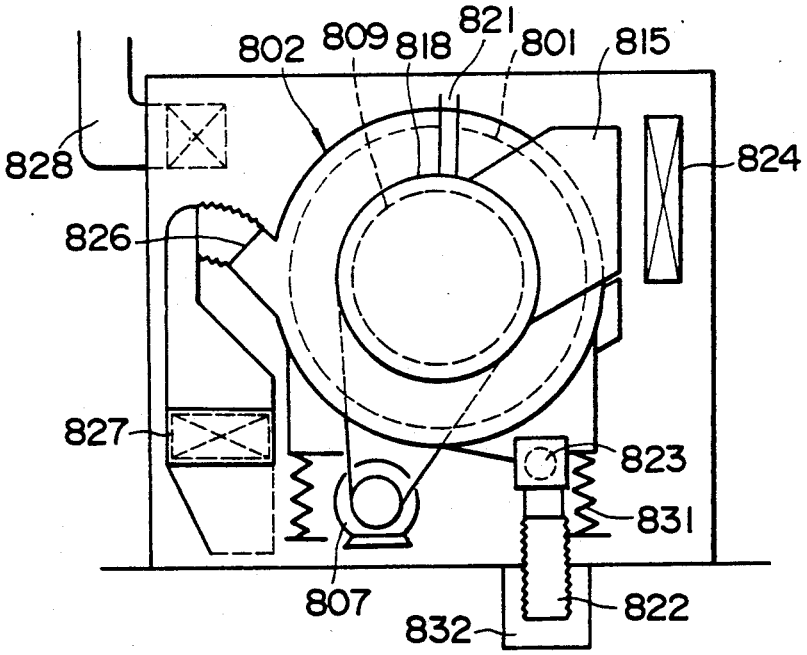
Figure 28:
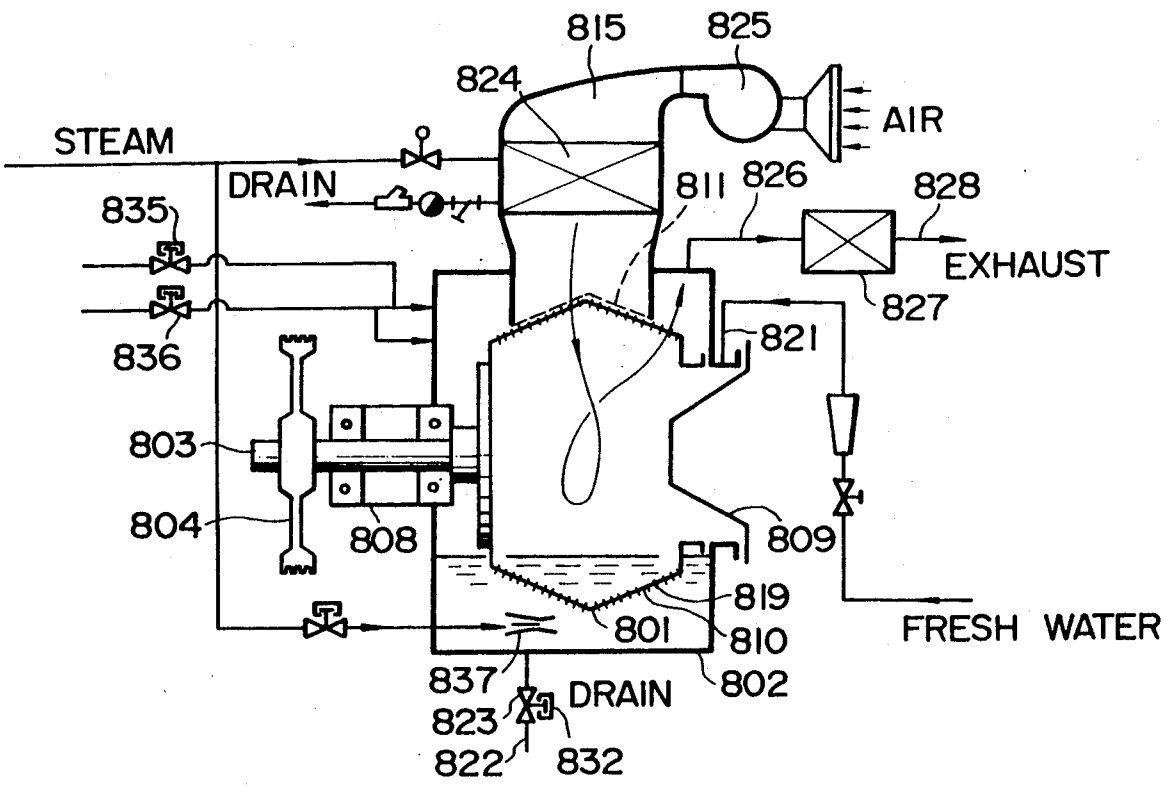
Figure 29A:
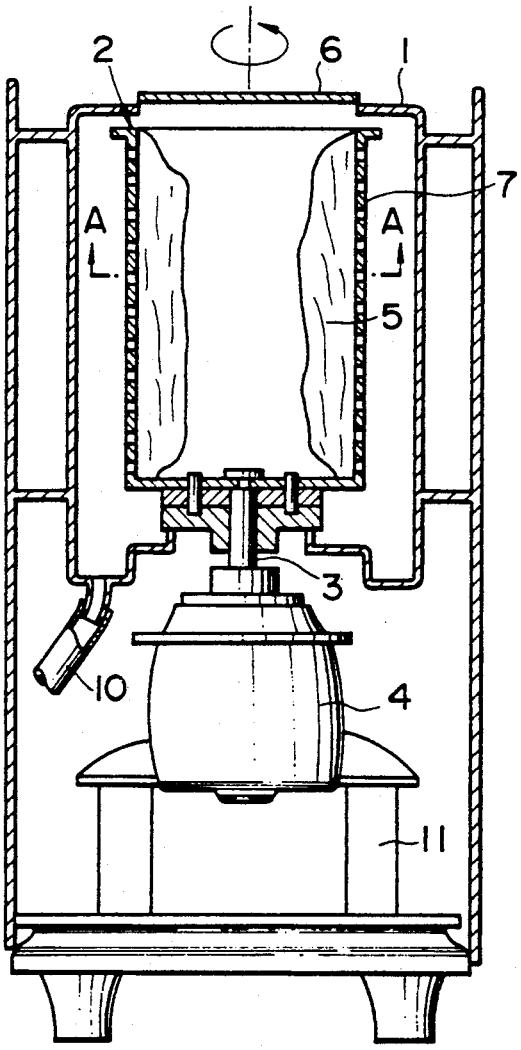
FIG. 29(A) PRIOR ART
FIG. 29(A) is a sectional side view of a conventional drum type drier.
Figure 29B:
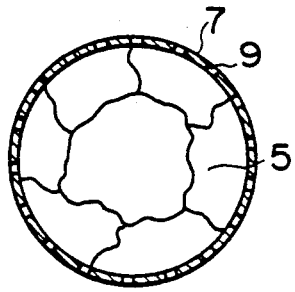
FIG. 29(B) PRIOR ART
FIG. 29(B) is a cross-sectional view of the drier in FIG. 29(A).
Figure 30:
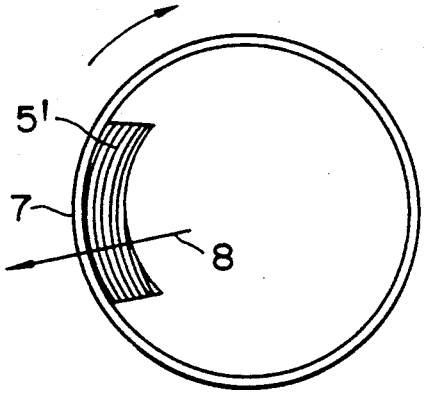
FIG. 30 is a schematic cross-sectional view of the drier similar to FIG. 29(B), particularly illustrating how the linen layer comes in contact with the inner wall surface of the rotary drum during a period of testing with respect to a period of dewatering.
Figure 31:
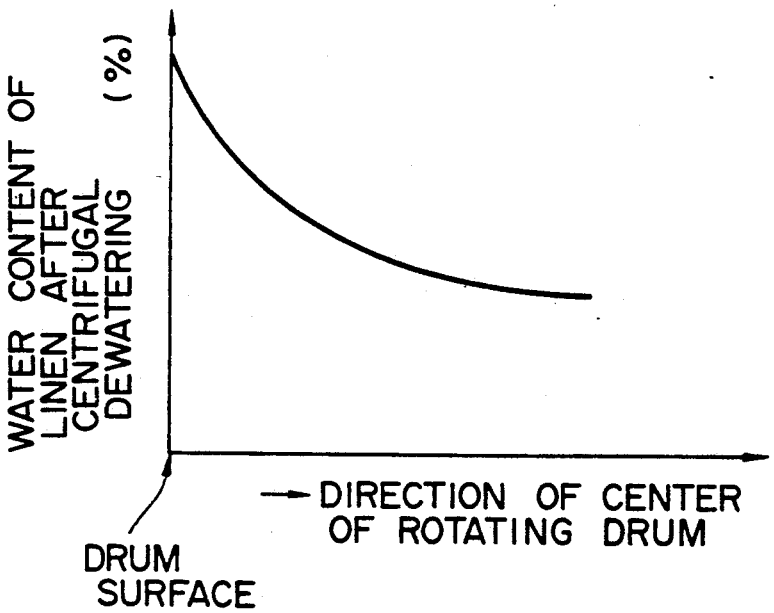
FIG. 31 PRIOR ART
FIG. 31 is a graph illustrating distribution of a water content during the period of testing as shown in FIG. 30.
Figure 32:
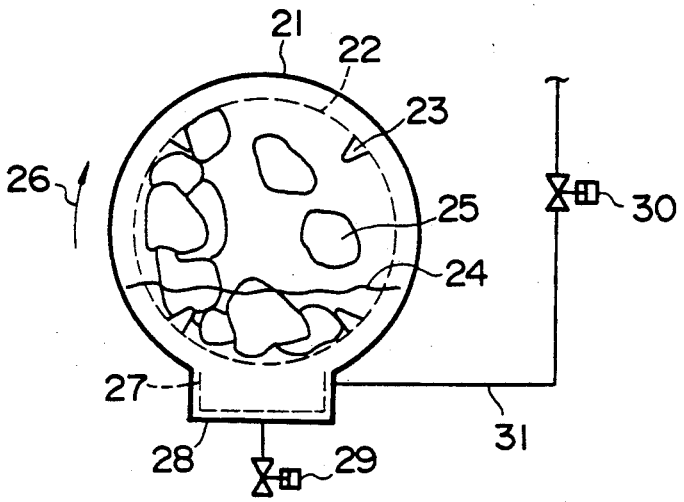
FIG. 32 PRIOR ART
FIG. 32 is a cross-sectional view schematically illustrating conventional drum type washing apparatus.
Figure 33:
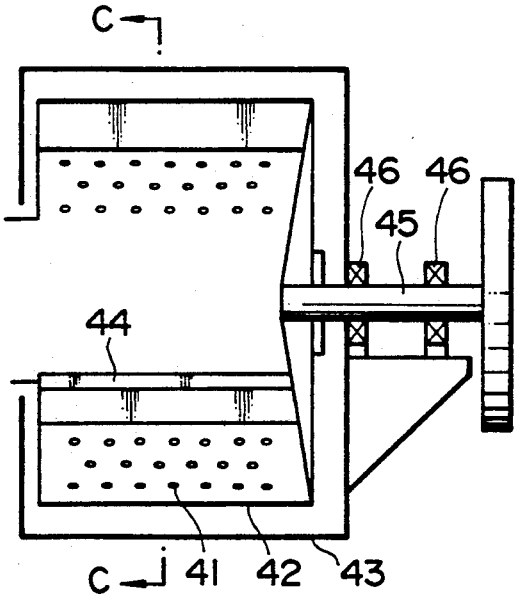
FIG. 33 PRIOR ART
FIG. 33 is a sectional side view illustrating another conventional drum type washing apparatus.
Figure 34:
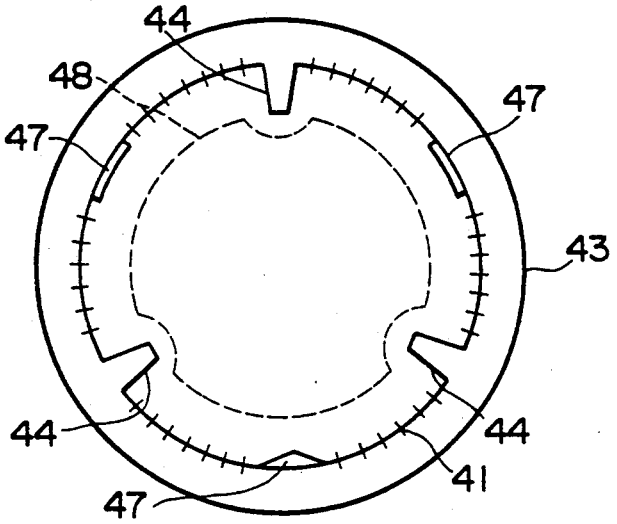
FIG. 34 PRIOR ART
FIG. 34 is a cross-sectional view of the apparatus taken in line C—C in FIG. 33.
Figure 35:
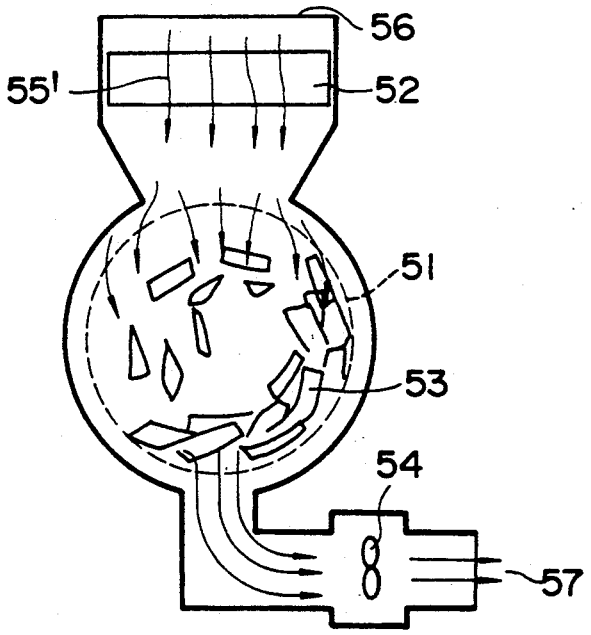
FIG. 35 PRIOR ART
FIGS. 35 and 36 are a sectional side view schematically illustrating essential components constituting another drum type washing apparatus, respectively.
Figure 36:
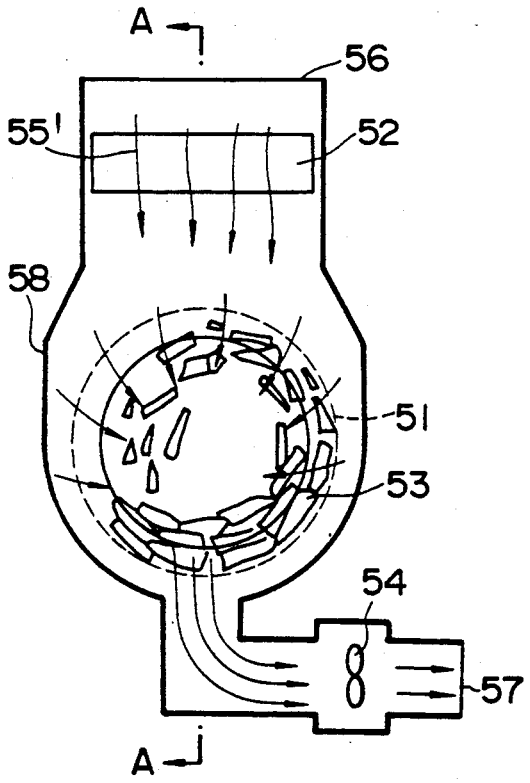
FIG. 36 PRIOR ART
Figure 37:
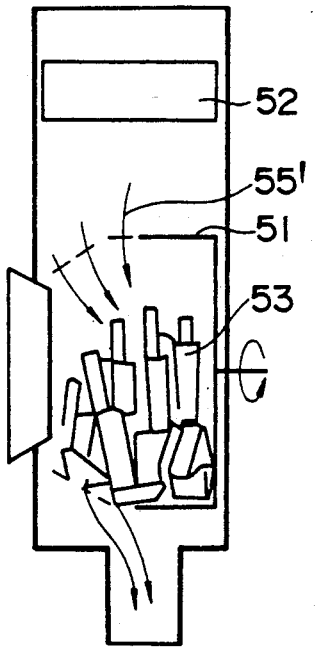
FIG. 37 PRIOR ART
FIG. 37 is a sectional side view of the apparatus taken in A—A in FIG. 36.

FIG. 26(A) is a schematic sectional view illustrating essential components constituting a drum type washing apparatus in accordance with an eighth embodiment of the present invention, FIG. 26(B) is a sectional view of the rotary drum, particularly illustrating that linens are brought in contact with the inner wall surface of the rotary drum, FIG. 27 is a schematic front view of the apparatus illustrating essential components constituting the apparatus and FIG. 28 is a schematic view illustrating a piping system for the apparatus.

Next, the essential components constituting the apparatus will be described in more details in the following.

802: outer drum—This is provided outside a rotary drum 801. A drum support 803 comprising a bracket, bearings and so forth for supporting a rotational shaft 803 is secured to one side of the apparatus, and the other side of the latter is closed with a door 809 so that linens 812 are introduced into the interior of the rotary drum 801 or discharged therefrom while the door 809 is kept opened.

809: door—This is opened when the linens 812 are introduced into the rotary drum 801 or discharged from the latter. It is turned about a pivotal pin (as represented by a pin 712 n FIG. 25.

811: air blowing nozzle—Air or hot air is blown into the interior of the rotary drum 801 through the air blowing nozzle 811.

824: heater—When hot air is to be supplied to the rotary drum 801, air is sucked from the outside by rotating a blower 825 and it is then heated by the heater 824 so that the hot air is introduced into the rotary drum 801. The heater 824 is generally constructed in accordance with a system wherein sucked air is heated using steam or hot oil by way of heat exchanging.

828: exhaust duct—Hot air which has been introduced into the rotary duct 801 during a step of drying is exhausted to the outside via the exhaust duct 828. A lint filter 827 is disposed midway of the exhaust duct 828 so that lints derived from linens are caught therein to prevent them from being discharged to the outside. Thus, only the waste air is exhausted to the outside via the exhaust duct 828.

Incidentally, a rotary drum 801, a rotational shaft 803, a pulley 804, a belt 805, a pulley 806, a motor 807, a drum support 808, a drum wall 810, linens 812, a duct 815, beaters 817, holes 819, water supply pipe 821, a water discharge pipe 822, a damper 823, an exhaust port 826, a lint filter 827, a speed changing unit 830, vibration proof units 831 and a waste water discharge trench 832 are substantially identical to the rotary drum 201, the rotational shaft 203, the pulley 204, the belt 205, the pulley 206, the motor 207, the drum support 208, the drum wall 210, the linens 212, the duct 215, the beaters 217, the holes 219, the water supply pipe 222, the damper 223, the exhaust port 226, the lint filter 227, the speed changing unit 230, the vibration proof units 231 and the waste water discharge trench 232 in accordance with the second embodiment of the present invention as described above. Thus, repeated description will not be required.

Next, operations of the apparatus in accordance with the eighth embodiment will be described below.

WASHING

A predetermined quantity of water is first supplied to the rotary drum 801 and the outer drum 802 via a water supply pipe 821. A number of holes 819 are drilled over the wall 810 of the rotary drum 801 so that the water which has been introduced into the interior of the rotary drum 801 flows through the holes 819 and is accumulated in the outer drum 802. As water is continuously supplied in that way, a water level in the rotary drum 801 is raised up gradually. When it is detected by a water level detector (not shown) that a predetermined water level is reached, water supply is interrupted. Then, the door 809 is opened so that linens 812 are introduced into the interior of the rotary drum 801. The motor is driven to rotate the rotary drum 801 at a predetermined rotational speed. Repeated rotations of the rotary drum 801 in normal and reverse directions are effective for preventing the linens 812 from being entangled with each other.

Detergent and assistant are supplied to the rotary drum 801 from a detergent supply unit 835 and an assistant supply unit 836 shown in FIG. 28 so that preliminary washing is performed. On completion of the preliminary washing, a damper 823 is opened to discharge waste water used for the preliminary washing in a waste water discharge trench 832 via a water discharge pipe 822. When completion of the discharging of waste water is detected by a sensor (not shown), the damper 823 is closed.

Next, washing water is introduced into the rotary drum 801 until a predetermined water level is reached and detergent and assistant are then supplied to the rotary drum 801 from the detergent/assistant supply unit (not shown) in the same manner as mentioned above with respect to the foregoing embodiments.

Then, a steam nozzle 837 shown in FIG. 28 is activated so that washing water is heated up to a predetermined temperature by blowing steam into water in the outer drum 802 through the steam nozzle 837. Rotation of the rotary drum 801 can be changed as required by changing the number of revolutions of the motor 807 under a control of the speed changing unit 830.

It should be noted that a period of time required for performing the step of washing can be remarkably reduced by employing a single injection nozzle or a plurality of liquid injection nozzles as mentioned above with respect to the third embodiment.

In this manner, normal washing is performed using hot water and on completion of the normal washing, rotation of the rotary drum 801 is adjusted to an intermediate rotational speed to separate water involved in the linens 812 under the effect of centrifugal force generated by rotation of the rotary drum 801. At this moment, of course the damper 823 is opened so as to permit waste washing water to be discharged to the outside from the apparatus via the water discharge pipe 822. Thereafter, the damper 823 is closed to supply water to the rotary drum 801 again so that a step of rinsing is initiated. The step of rinsing may be executed in the same manner as the preceding step of washing. On completion of the step of rinsing which has been practiced by alternately repeating water supply and water discharge, the process goes to a step of dewatering.

DEWATERING

The rotary drum 801 is rotated by the motor 807 in cooperation of the speed changing unit 830 to generate an acceleration as represented by the range of 1 to 1.5 G round the inner wall surface of the rotary drum 801. This enables the linens 812 in the rotary drum 801 to be distributed uniformly round the inner wall surface of the rotary drum 801. After this operative state has been reached, the rotary drum 801 is rotated at a higher speed so that water involved in the linens 812 is separated therefrom under the effect of centrifugal force and it is then discharged to the outer drum 802 through the holes 819 on the rotary drum 801. The waste water is further discharged in the waste water discharge trench 822 from the outer drum 802 via the water discharge pipe 822.

Here, results derived from a number of tests conducted as a so-called corrugation angle of the rotary drum 801 was varied are as described above with reference to FIGS. 8 to 10.

It is assumed that the corrugation angle is set to O (as shown in FIG. 26(A)) relative to the direction F of centrifugal force.

Data derived from a series of measurements made with respect to a water content of the linens 812 as the corrugation angle $\theta$ was varied are shown in FIGS. 8 and 10. The data represent values obtained during a period of dewatering which was performed with the linens for 4 minutes under a condition of the rotational acceleration represented by 350 G. Here, G representative of the rotational acceleration can be calculated in accordance with the following formula.

$$G = \frac{R}{9.8} \times \left(\frac{2\pi n}{60}\right)^2$$

where R represents a radius of the rotary drum in meter and n does the number of revolutions of the rotary drum in rpm.

As shown in FIG. 8, the linen layer exhibits a water content of 80% when the corrugation angle $\theta$ is set to 180° (as is the case with a conventional flat type apparatus) and it exhibits a water content of 65% when it is set to 120°. This means that when the apparatus of the present invention is used, water can be removed from the linen layer by 15% in terms of a water content more than the conventional apparatus. When the corrugation angle is set to 60°, the linen layer exhibits a water content of 60%. This means that a property of water content can be improved by 20% more than the conventional apparatus.

On the other hand, as shown in FIG. 10, the apparatus of the present invention assures that linens located in the proximity of the inner wall surface can be satisfactorily dewatered with few fluctuation in distribution of a water content after completion of the step of dewatering as viewed toward the central part of the rotary drum and thereby an effectiveness of dewatering can be increased as a whole.

Specifically, with respect to a conventional rotary drum, a high degree of difference appears between the water content round the inner wall surface of the rotary drum and the water content at the central part of the same and the dewatered linens exhibit a high water content in such a manner that they have a water content of 90% round the inner wall surface and a water content of 65% at the central part of the rotary drum. On the contrary, the rotary drum of the present invention of which corrugation angle $\theta$ is set to 120° exhibits a water content of 70% round the inner wall surface and a water content of 63% at the central part of the rotary drum. Thus, it is found that a difference therebetween remains at a low level and the linen layer exhibits a lower value of water content as a whole. This means that the linen layer is dewatered at a high efficiency as a whole with the rotary drum of the present invention.

As the rotary drum is rotated, the linens to be washed are brought in contact with the inner wall surface of the rotary drum. Thus, a certain intensity of force which differs in dependence on an amount of corrugation angle of the rotary disc is required for removing them from the inner wall surface of the rotary drum. FIG. 9 is a diagram which illustrates a relationship between a corrugation angle $\theta$ to be varied and a force required for removing the linen layer from the inner wall surface of the rotary drum in terms of an index.

In detail, in a case where the rotary drum has a corrugation angle of 180° (as is the case with a conventional rotary drum), a force represented by about 10 indexes is required when the linen layer is removed by a force effective in the direction of centrifugal force (representative of peeling in the horizontal direction), whereas a force represented by about 70 indexes is required due to penetration of the linens into the holes 819 on the wall of the rotary drum 801, when the linen layer is removed in the direction which intersects the direction of centrifugal force at right angles (representative of peeling in the vertical direction). If the corrugation angle is set to a smaller value, e.g., 60°, a force represented by 180 indexes is required as viewed in the horizontal direction and a force represented by 240 indexes is required as viewed in the vertical direction. Namely, a force represented by about 200 indexes effective in the horizontal direction and a force represented by more than 200 indexes effective in the vertical direction is required for the purpose of removing the linen layer from the inner wall surface of the rotary drum. This means that the linen layer can not be removed from the inner wall surface of the rotary drum unless a high intensity of force is imparted to it, because the linens are brought in tight contact with the inner wall surface as the rotary drum is rotated. Accordingly, the rotary drum having a corrugation angle of 60° has no practicability.

Consequently, it has been found that the corrugation angle should be determined in the range of 90° to 160°, preferably in the range of 120° to 150° in order to improve a property of water content in comparison with the conventional rotary drum and prevent the linen layer from being brought in tight contact with the inner wall surface of the rotary drum.

Further, with respect to the corrugated type rotary drum as shown in FIG. 26, linens tend to get together under the influence of centrifugal force as represented by F in an area where the rotary drum has a larger diameter, i.e., in an apex portion of the drum wall during a period of dewatering. Thus, since the corrugated type rotary drum of the present invention is so constructed that an unbalanced load appears at the center of weight or at a position located in the proximity of the center of weight, a magnitude of vibration caused due to the unbalanced load during the step of dewatering can be reduced to a minimized level. Consequently, it has been found that the rotary drum of the present invention is ideal from the viewpoint of reduction of the vibration during the step of dewatering.

DRYING

When it is found that the step of dewatering comes near to termination, a step of drying is initiated without any discontinuance by introducing hot air heated by the heater 824 into the rotary drum 801 via the duct 815 and the blowing nozzle 811. When the linens 812 come in tight contact with the inner wall surface of the rotary drum 801 as shown in FIG. 26(B), this makes it impossible to uniformly dry the linens 812 within a short period of time irrespective of introduction of the hot air into the interior of the rotary drum 801. Namely, to assure that steps of washing, dewatering and drying can be executed in a single unit, it is essential that after completion of a step of dewatering, the linens 812 can be removed from the inner wall surface of the rotary drum 801 without any necessity for manual operation. To this end, the number of revolutions of the rotary drum should be determined so that a rotational acceleration remains at a level less than 1 G, preferably in the range of 0.7 to 0.8. Termination of the step of drying can be recognized by detecting by a temperature sensor or a moisture sensor (not shown) attached to the exhaust port 826 that a predetermined temperature or a predetermined moisture is reached.

To assure that a period of time required for executing the step of drying can be shortened, it is recommendable that the fifth embodiment of the present invention as mentioned above is employed in addition to the eighth embodiment.

Specifically, linens in the rotary drum can be uniformly heated and dried within a short period of time by blowing hot air into the interior of the rotary drum in both axial and peripheral directions while changing the blowing of hot air in the axial direction to the blowing of hot air in the peripheral direction and vice versa for every predetermined time.

EASY REMOVAL OF WASHED LINENS

In order to easily remove washed linens from the rotary drum, it is preferable that removal is achieved in such a manner as mentioned above with reference to FIGS. 24 and 25 with respect to the preceding seventh embodiment. Accordingly, repeated description will not be required.

We claim:

1. A drum type washing apparatus for carrying out at least one of washing, dehydrating and drying in a rotary drum, wherein the rotary drum has a center, the washing apparatus comprising:

the rotary drum being made of a perforated plate, said rotary drum having a peripheral wall with a pot-shaped contour with a single corrugated portion in an axial direction of said rotary drum so that the peripheral wall forms a wall surface which does not intersect at right angles a direction of action of centrifugal force generated by rotation of the rotary drum, the corrugated portion having an apex formed with a large number of holes, the entire peripheral also having a large number of holes therein, said single corrugated portion having a corrugated angle which assumes a wall surface opened in a range of 90°–160° including the direction of action of centrifugal force;

an air duct having an air-guide blower and a heater therein so as to heat the air;

a nozzle connected to said air duct and arranged so as to face slant-wise upwardly of said rotary drum and open toward the center of said rotary drum; and an exhaust discharge opening formed laterally from said rotary drum, so that hot air can be supplied to and discharged from said rotary drum.

2. A drum type washing apparatus for carrying out at least one of washing, dehydrating and drying in a rotary drum, the washing apparatus comprising:

the rotary drum being made of a perforated plate, said rotary drum having a peripheral wall with a pot-shaped contour with a single corrugated portion in an axial direction of said rotary drum so that the peripheral wall forms a wall surface which does not intersect at right angles a direction of action of centrifugal force generated by rotation of the rotary drum, the corrugated portion having an apex formed with a large number of holes, the entire peripheral also having a large number of holes therein, said single corrugated portion having a corrugated angle which assumes a wall surface opened in a range of 90°–160° including the direction of action of centrifugal force;

an outer drum arranged so as to support said rotary drum, said outer drum having a sidewall and an inlet portion;

an air duct having an air-guide blower and a heater arranged therein for heating the air;

a first duct connected to said air duct via a first damper and opened in an inlet portion of said outer drum;

a second duct connected to said air duct through a second damper and open at a sidewall of said outer drum; and a discharge opening arranged at said rotary drum so that hot air can be supplied to and discharged from said rotary drum, said first and said second dampers being openable or closeable so as to alternately blow hot air into said rotary drum from the axial direction and a peripheral direction of said rotary drum.

* * * * *